US009116481B2

(12) United States Patent
Yoshikawa et al.

(10) Patent No.: US 9,116,481 B2
(45) Date of Patent: Aug. 25, 2015

(54) FIXING DEVICE INCLUDING A REFLECTOR AND IMAGE FORMING APPARATUS

(71) Applicants: Masaaki Yoshikawa, Tokyo (JP); Takayuki Seki, Kanagawa (JP); Yuji Arai, Kanagawa (JP); Hiroshi Yoshinaga, Chiba (JP); Ryuuichi Mimbu, Kanagawa (JP); Takuya Seshita, Kanagawa (JP); Shuntaro Tamaki, Kanagawa (JP); Takeshi Yamamoto, Kanagawa (JP); Takahiro Imada, Kanagawa (JP); Hajime Gotoh, Kanagawa (JP); Kazuya Saito, Kanagawa (JP); Yutaka Ikebuchi, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP)

(72) Inventors: Masaaki Yoshikawa, Tokyo (JP); Takayuki Seki, Kanagawa (JP); Yuji Arai, Kanagawa (JP); Hiroshi Yoshinaga, Chiba (JP); Ryuuichi Mimbu, Kanagawa (JP); Takuya Seshita, Kanagawa (JP); Shuntaro Tamaki, Kanagawa (JP); Takeshi Yamamoto, Kanagawa (JP); Takahiro Imada, Kanagawa (JP); Hajime Gotoh, Kanagawa (JP); Kazuya Saito, Kanagawa (JP); Yutaka Ikebuchi, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/269,358

(22) Filed: May 5, 2014

(65) Prior Publication Data

US 2014/0341627 A1 Nov. 20, 2014

(30) Foreign Application Priority Data

May 16, 2013 (JP) ..... 2013-103876
Mar. 3, 2014 (JP) ..... 2014-040326

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2017; G03G 15/2053
USPC ..... 399/329; 219/216
See application file for complete search history.

(56) References Cited

U.S. PATENT DOCUMENTS

| | | | | |
|---|---|---|---|---|
| 7,446,281 | B2 * | 11/2008 | Kagawa et al. | 219/216 |
| 8,588,670 | B2 | 11/2013 | Shimokawa et al. | |
| 2007/0292175 | A1 | 12/2007 | Shinshi | |
| 2014/0072355 | A1 | 3/2014 | Tamaki et al. | |

FOREIGN PATENT DOCUMENTS

| | | | |
|---|---|---|---|
| EP | 2 706 412 | A2 | 3/2014 |
| JP | 63-180870 | U | 11/1988 |
| JP | 5-188805 | U | 7/1993 |
| JP | 2004-287318 | | 10/2004 |
| JP | 2007-334205 | | 12/2007 |
| JP | 2008-052061 | | 3/2008 |
| JP | 2008-175988 | | 7/2008 |
| JP | 2009-103759 | | 5/2009 |
| JP | 2012-230293 | | 11/2012 |

OTHER PUBLICATIONS

The Extended European Search Report issued Sep. 17, 2014, in application No./ patent No. 14167456.4-1560.

* cited by examiner

*Primary Examiner* — William J Royer
(74) *Attorney, Agent, or Firm* — Oblon, McClelland, Maier & Neustadt, L.L.P.

(57) ABSTRACT

A fixing device includes a fixing rotator rotatable in a predetermined direction of rotation and a nip formation assembly contacting an inner circumferential surface of the fixing rotator. An opposed rotator presses against the nip formation assembly via the fixing rotator to form a fixing nip between the fixing rotator and the opposed rotator, through which a recording medium is conveyed. A support, disposed opposite the inner circumferential surface of the fixing rotator, supports the nip formation assembly. A heater, disposed opposite the inner circumferential surface of the fixing rotator, heats the fixing rotator. A reflector, disposed opposite an outer circumferential surface of the fixing rotator, reflects heat radiated from the fixing rotator onto the fixing rotator. The reflector spans a circumferential span of the fixing rotator where the fixing rotator is spaced apart from the support with a decreased interval therebetween.

20 Claims, 21 Drawing Sheets

FIXING DEVICE INCLUDING A REFLECTOR AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-103876, filed on May 16, 2013, and 2014-040326, filed on Mar. 3, 2014, in the Japanese Patent Office, the entire disclosure of each of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator heated by a heater and an opposed rotator contacting the fixing rotator to form a fixing nip therebetween through which a recording medium bearing a toner image is conveyed. As the fixing rotator and the opposed rotator rotate and convey the recording medium bearing the toner image through the fixing nip, the fixing rotator heated to a predetermined fixing temperature and the opposed rotator together heat and melt toner of the toner image, thus fixing the toner image on the recording medium.

In order to use heat effectively by suppressing unnecessary heat dissipation to a component outside the fixing device and retaining heat inside the fixing device, the fixing device may incorporate a reflector or a heat shield disposed opposite an outer circumferential surface of the fixing rotator to reflect heat onto the fixing rotator.

In order to suppress heat dissipation to the component outside the fixing device, the reflector or the heat shield may be disposed opposite the fixing rotator in an increased circumferential span of the fixing rotator. However, a temperature sensor that detects the temperature of the fixing rotator and a separator that separates the recording medium from the fixing rotator are disposed opposite the outer circumferential surface of the fixing rotator. Accordingly, the reflector or the heat shield may not span the increased circumferential span of the fixing rotator to avoid interference with the temperature sensor and the separator. Since various components are accommodated inside the limited space of the compact fixing device, it is difficult for the reflector or the heat shield to occupy a substantial space. Accordingly, it is requested to locate the reflector or the heat shield in a decreased space while using heat effectively to heat the fixing rotator.

SUMMARY

This specification describes below an improved fixing device. In one exemplary embodiment, the fixing device includes a fixing rotator rotatable in a predetermined direction of rotation and a nip formation assembly contacting an inner circumferential surface of the fixing rotator. An opposed rotator presses against the nip formation assembly via the fixing rotator to form a fixing nip between the fixing rotator and the opposed rotator, through which a recording medium is conveyed. A support, disposed opposite the inner circumferential surface of the fixing rotator, supports the nip formation assembly. A heater, disposed opposite the inner circumferential surface of the fixing rotator, heats the fixing rotator. A reflector, disposed opposite an outer circumferential surface of the fixing rotator, reflects heat radiated from the fixing rotator onto the fixing rotator. The reflector spans a circumferential span of the fixing rotator where the fixing rotator is spaced apart from the support with a decreased interval therebetween.

This specification further describes an improved image forming apparatus. In one exemplary embodiment, the image forming apparatus includes an image forming device to form a toner image and the fixing device described above to fix the toner image formed by the image forming device on the recording medium.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
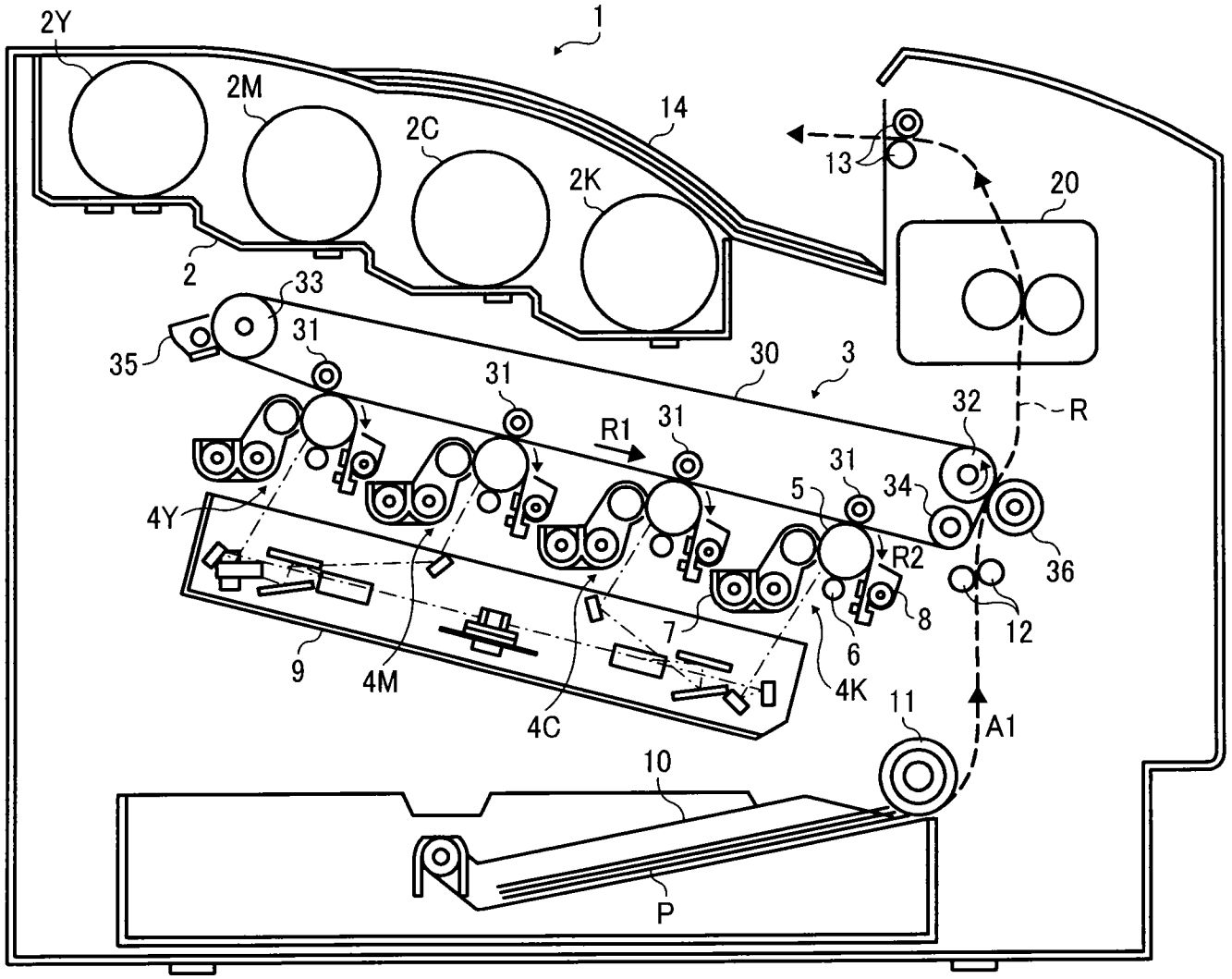
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip at a proper time.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the outside of the image forming apparatus 1, that is, the output tray 14 that stocks the recording medium P.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
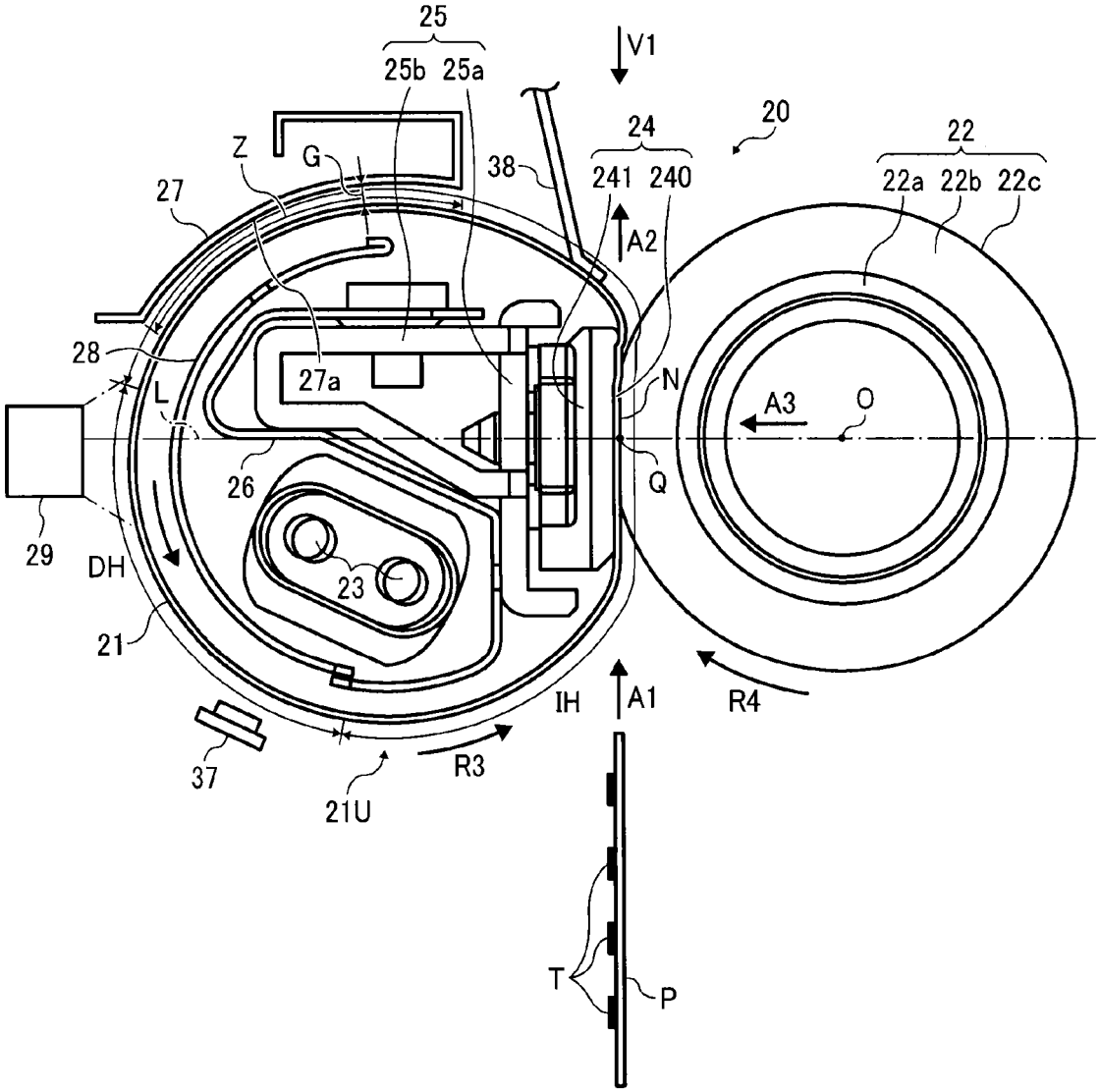
FIG. 2 is a vertical sectional view of a fixing device incorporated in the image forming apparatus shown in FIG. 1 illustrating a heat shield incorporated therein that is situated at a shield position and an exterior reflector.
Figure 3:
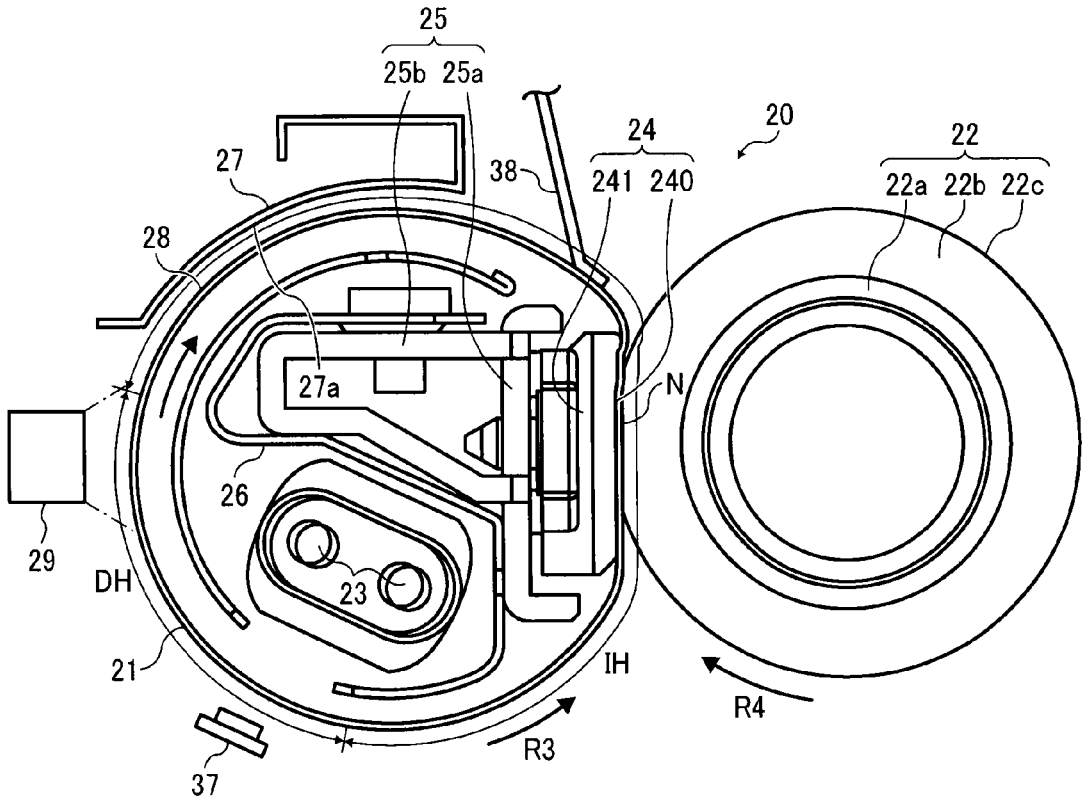
FIG. 3 is a vertical sectional view of the fixing device shown in FIG. 2 illustrating the heat shield situated at a retracted position.

With reference to FIGS. 2 and 3, a description is provided of a construction of the fixing device 20 incorporated in the image forming apparatus 1 described above.

FIG. 2 is a vertical sectional view of the fixing device 20 illustrating a heat shield 28 incorporated therein that is situated at a shield position. FIG. 3 is a vertical sectional view of the fixing device 20 illustrating the heat shield 28 situated at a retracted position.

As shown in FIG. 2, the fixing device 20 (e.g., a fuser) includes a fixing belt 21 serving as a fixing rotator or an endless belt formed into a loop and rotatable in a rotation direction R3; a pressure roller 22 serving as an opposed rotator disposed opposite an outer circumferential surface of the fixing belt 21 to separably or inseparably contact the fixing belt 21 and rotatable in a rotation direction R4 counter to the rotation direction R3 of the fixing belt 21; a halogen heater pair 23 serving as a heater disposed inside the loop formed by the fixing belt 21 to heat the fixing belt 21; a nip formation assembly 24 disposed inside the loop formed by the fixing belt 21 and pressing against the pressure roller 22 via the fixing belt 21 to form a fixing nip N between the fixing belt 21 and the pressure roller 22; a stay 25 serving as a support disposed inside the loop formed by the fixing belt 21 and contacting and supporting the nip formation assembly 24; an interior reflector 26 disposed inside the loop formed by the fixing belt 21 to reflect light or heat radiated from the halogen heater pair 23 onto the fixing belt 21; an exterior reflector 27 disposed outside the loop formed by the fixing belt 21 to reflect heat radiated from the fixing belt 21 back onto the fixing belt 21; the heat shield 28 interposed between the halogen heater pair 23 and the fixing belt 21 to shield the fixing belt 21 from the halogen heater pair 23; a temperature sensor 29 serving as a temperature detector disposed opposite the outer circumferential surface of the fixing belt 21 to detect the temperature of the fixing belt 21; an abnormal temperature detector 37 disposed opposite the outer circumferential surface of the fixing belt 21 to detect the abnormal temperature, that is, overheating, of the fixing belt 21; and a separator 38 disposed downstream from the fixing nip N in the recording medium conveyance direction A1 to separate a recording medium P discharged from the fixing nip N from the fixing belt 21.

The fixing belt 21 and the components disposed inside the loop formed by the fixing belt 21, that is, the halogen heater pair 23, the nip formation assembly 24, the stay 25, the interior reflector 26, and the heat shield 28, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated to a predetermined fixing temperature quickly. However, as the pressure roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 80 micrometers. The elastic layer having the thickness not smaller than about 80 micrometers elastically deforms to absorb slight surface asperities of the fixing belt 21, preventing variation in gloss of the toner image T on the recording medium P.

According to this exemplary embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 80 micrometers to about 300 micrometers; and the release layer having a thickness in a range of from about 3 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly presses the pressure roller 22 against the nip formation assembly 24 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a predetermined length in the recording medium conveyance direction A1. According to this exemplary embodiment, the pressure roller 22 is pressed against the fixing belt 21. Alternatively, the pressure roller 22 may merely contact the fixing belt 21 with no pressure therebetween.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

As shown in FIG. 2, according to this exemplary embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater pair 23.

The power supply situated inside the image forming apparatus 1 supplies power to the halogen heater pair 23 so that the halogen heater pair 23 heats the fixing belt 21. A controller (e.g., a processor), that is, a central processing unit (CPU) provided with a random-access memory (RAM) and a read-only memory (ROM), for example, operatively connected to the halogen heater pair 23 and the temperature sensor 29 controls the halogen heater pair 23 based on the temperature of the outer circumferential surface of the fixing belt 21 detected by the temperature sensor 29 so as to adjust the temperature of the fixing belt 21 to a desired fixing temperature. Alternatively, the controller may be operatively connected to a temperature sensor disposed opposite the pressure roller 22 to detect the temperature of the pressure roller 22 so that the controller predicts the temperature of the fixing belt 21 based on the temperature of the pressure roller 22 detected by the temperature sensor, thus controlling the halogen heater pair 23.

A detailed description is now given of a configuration of the abnormal temperature detector 37.

The abnormal temperature detector 37 detects that the temperature of the fixing belt 21 reaches an abnormal temperature not lower than a predetermined temperature. For example, the abnormal temperature detector 37 is a mechanically detective, thermostat such as a bimetallic thermostat or a shape memory alloy thermostat. When the thermostat detects the temperature of the fixing belt 21 not lower than a predetermined temperature of about 250 degrees centigrade, an interior contact of the thermostat opens. Accordingly, the thermostat operatively connected to the halogen heater pair 23 interrupts power supply to the halogen heater pair 23 to prohibit the halogen heater pair 23 from heating the fixing belt 21. Consequently, the thermostat prevents overheating of the fixing belt 21 which may thermally damage the fixing belt 21. Alternatively, the thermostat may be configured to alert when the thermostat detects an abnormal temperature of the fixing belt 21.

The thermostat may be a contact thermostat in contact with the fixing belt 21 or a non-contact thermostat isolated from the fixing belt 21. Instead of the thermostat, an infrared radiation thermometer, a thermistor, or the like may be used as the abnormal temperature detector 37.

According to this exemplary embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to the sizes of the recording media P available in the image forming apparatus 1. Alternatively, instead of the halogen heater pair 23, an infrared heater such as a carbon heater may be employed as a heater that heats the fixing belt 21.

A detailed description is now given of a construction of the nip formation assembly 24.

The nip formation assembly 24 includes a base pad 241 and a slide sheet 240 (e.g., a low-friction sheet) covering an outer surface of the base pad 241. For example, the slide sheet 240 covers an opposed face of the base pad 241 disposed opposite the fixing belt 21. A longitudinal direction of the base pad 241 is parallel to an axial direction of the fixing belt 21 or the pressure roller 22. The base pad 241 receives pressure from the pressure roller 22 to define the shape of the fixing nip N. According to this exemplary embodiment, the fixing nip N is planar in cross-section as shown in FIG. 2. Alternatively, the fixing nip N may be concave with respect to the pressure roller 22 or have other shapes. The slide sheet 240 reduces friction between the base pad 241 and the fixing belt 21 sliding thereover as the fixing belt 21 rotates in the rotation direction R3. Alternatively, the base pad 241 may be made of a low friction material. In this case, the slide sheet 240 is not interposed between the base pad 241 and the fixing belt 21.

The base pad 241 is made of a heat resistant material resistant against temperatures of 200 degrees centigrade or higher to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 241 is made of general heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The base pad 241 is mounted on and supported by the stay 25. Accordingly, even if the base pad 241 receives pressure from the pressure roller 22, the base pad 241 is not bent by the pressure and therefore produces a uniform nip width throughout the entire width of the pressure roller 22 in the axial direction thereof. The stay 25 is made of metal having an increased mechanical strength, such as stainless steel and iron, to prevent bending of the nip formation assembly 24.

A detailed description is now given of a construction of the stay 25.

The stay 25 includes a base 25*a* extending vertically in FIG. 2 in the recording medium conveyance direction A1 and an arm 25*b* extending from the base 25*a* horizontally in FIG. 2 in a pressurization direction A3 in which the pressure roller 22 exerts pressure to the fixing belt 21. The arm 25*b* projecting from the base 25*a* creates an increased length of the stay 25 in the pressurization direction A3 in cross-section, increasing the section modulus of the stay 25 and therefore enhancing the mechanical strength of the stay 25. Thus, the stay 25, even if it is situated inside the fixing belt 21 having a decreased loop diameter, has an increased mechanical strength.

The arm 25*b* extends in the pressurization direction A3 inside a space above a hypothetical line L passing through a center Q of the fixing nip N in the recording medium conveyance direction A1 and an axis O of the pressure roller 22 in FIG. 2. Contrarily, the halogen heater pair 23 is situated below the hypothetical line L in FIG. 2 so as not to interfere with the arm 25*b* of the stay 25. Alternatively, the halogen heater pair 23 may be situated above the hypothetical line L and the arm 25*b* of the stay 25 may be situated below the hypothetical line L. However, the halogen heater pair 23, if it is situated below the hypothetical line L, heats the fixing belt 21 effectively at a position upstream from the fixing nip N in the rotation direction R3 of the fixing belt 21 immediately before the fixing belt 21 enters the fixing nip N.

A detailed description is now given of a configuration of the interior reflector 26.

The interior reflector 26 disposed opposite the inner circumferential surface of the fixing belt 21 is mounted on and supported by the stay 25 and disposed opposite the halogen heater pair 23. The interior reflector 26 reflects light or heat radiated from the halogen heater pair 23 thereto onto the fixing belt 21, suppressing conduction of heat from the halogen heater pair 23 to the stay 25 or the like. Thus, the interior reflector 26 facilitates efficient heating of the fixing belt 21, saving energy. For example, the interior reflector 26 is made of aluminum, stainless steel, or the like. If the interior reflector 26 includes an aluminum base treated with silver-vapordeposition to decrease radiation and increase reflectance of light, the interior reflector 26 heats the fixing belt 21 effectively.

A detailed description is now given of a configuration of the exterior reflector 27.

The exterior reflector 27 disposed opposite the outer circumferential surface of the fixing belt 21 reflects heat radiated from the fixing belt 21 to an outside of the fixing belt 21 toward the fixing belt 21. The exterior reflector 27 is made of a material similar to the material of the interior reflector 26.

A detailed description is now given of a configuration of the heat shield 28.

The heat shield 28 is a thin plate, having a thickness in a range of from about 0.1 mm to about 1.0 mm, curved in a circumferential direction of the fixing belt 21 along the inner circumferential surface thereof. For example, the heat shield 28 is formed in an arch in cross-section. The heat shield 28 is made of a heat resistant material, for example, metal such as aluminum, iron, and stainless steel or ceramic. The heat shield 28 is movable in the circumferential direction of the fixing belt 21. As shown in FIG. 2, a circumference of the fixing belt 21 is divided into two sections: a circumferential, direct heating span DH where the halogen heater pair 23 is disposed opposite and heats the fixing belt 21 directly and a circumferential, indirect heating span IH where the halogen heater pair 23 is disposed opposite the fixing belt 21 indirectly via the components other than the heat shield 28, that is, the interior reflector 26, the stay 25, the nip formation assembly 24, and the like. The heat shield 28 moves to the shield position shown in FIG. 2 where the heat shield 28 is disposed opposite the halogen heater pair 23 directly and the direct heating span DH of the fixing belt 21 to shield the fixing belt 21 from the halogen heater pair 23.

Conversely, the heat shield 28 moves to the retracted position shown in FIG. 3 where the heat shield 28 retracts from the direct heating span DH to the indirect heating span IH of the fixing belt 21 and therefore is disposed opposite the halogen heater pair 23 indirectly. That is, the heat shield 28 is behind the interior reflector 26 and the stay 25 and therefore disposed opposite the halogen heater pair 23 via the interior reflector 26 and the stay 25. Thus, the heat shield 28 does not shield the fixing belt 21 from the halogen heater pair 23.

Figure 4:
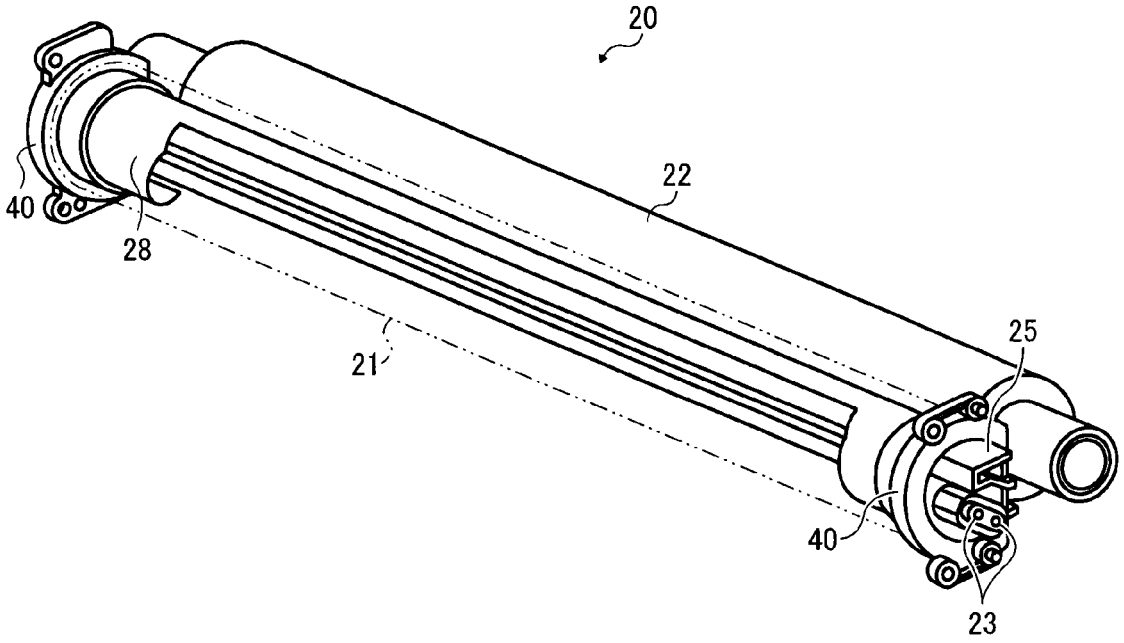
FIG. 4 is a partial perspective view of the fixing device shown in FIG. 3.

With reference to FIG. 4, a description is provided of a configuration of flanges 40 of the fixing device 20.

FIG. 4 is a partial perspective view of the fixing device 20. As shown in FIG. 4, the fixing device 20 further includes the flanges 40 serving as a belt holder inserted into both lateral ends of the fixing belt 21 in the axial direction thereof, respectively, to rotatably support the fixing belt 21. Both lateral ends of the flanges 40, the halogen heater pair 23, and the stay 25 in the axial direction of the fixing belt 21 are mounted on and supported by a pair of side plates of the fixing device 20, respectively.

Figure 5:
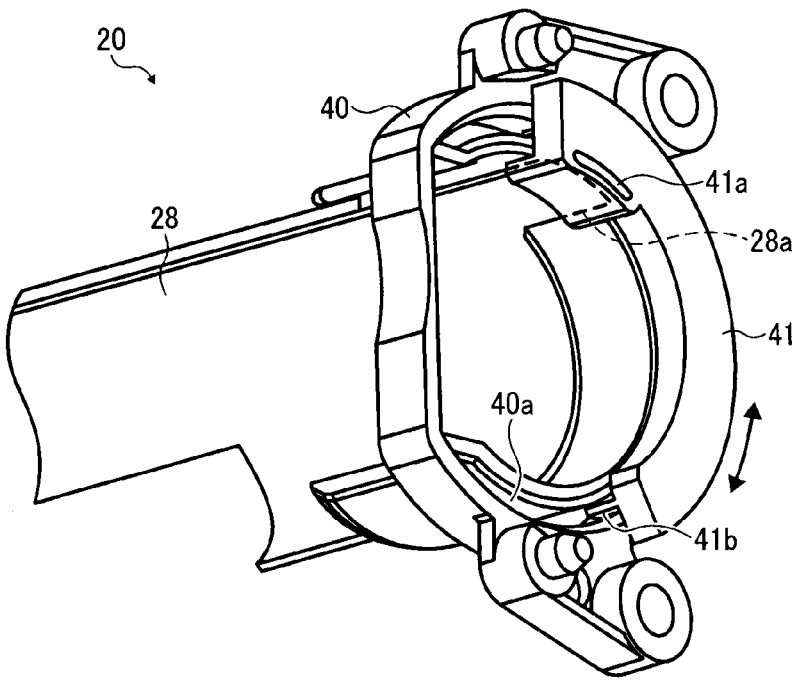
FIG. 5 is a partial perspective view of the fixing device shown in FIG. 2 illustrating one lateral end of the heat shield in an axial direction thereof.

With reference to FIG. 5, a description is provided of a construction of a support mechanism that supports the heat shield 28.

FIG. 5 is a partial perspective view of the fixing device 20 illustrating one lateral end of the heat shield 28 in a longitudinal direction thereof parallel to the axial direction of the fixing belt 21. As shown in FIG. 5, the heat shield 28 is supported by an arcuate slider 41 rotatably or slidably attached to the flange 40. For example, a projection 28*a* disposed at each lateral end of the heat shield 28 in the longitudinal direction thereof is inserted into a hole 41*a* produced in the slider 41. Thus, the heat shield 28 is attached to the slider 41. The slider 41 includes a tab 41*b* projecting inboard in the axial direction of the fixing belt 21 toward the heat shield 28. As the tab 41*b* of the slider 41 is inserted into an arcuate groove 40*a* produced in the flange 40, the slider 41 is slidably movable in the groove 40*a*. Accordingly, the heat shield 28, together with the slider 41, is rotatable or movable in a circumferential direction of the flange 40. The flange 40 and the slider 41 are made of resin.

Although FIG. 5 illustrates the support mechanism that supports the heat shield 28 at one lateral end in the longitudinal direction thereof, another lateral end of the heat shield 28 in the longitudinal direction thereof is also supported by the support mechanism shown in FIG. 5. Thus, another lateral end of the heat shield 28 is also rotatably or movably supported by the slider 41 slidable in the groove 40*a* of the flange 40.

Figure 6:
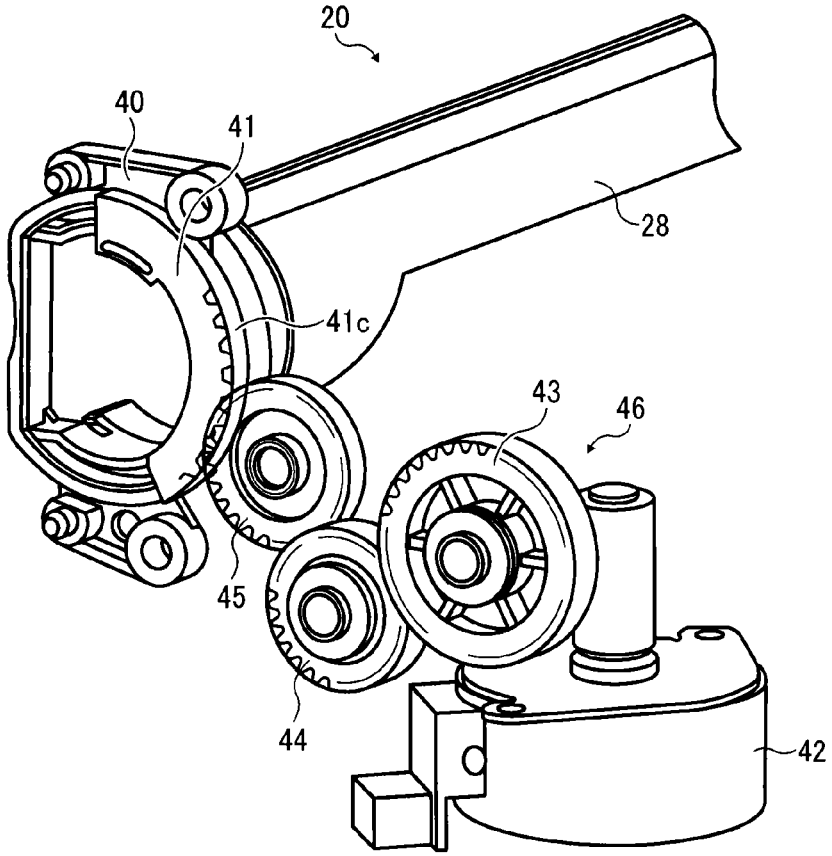
FIG. 6 is a partial perspective view of the fixing device shown in FIG. 2 illustrating a driver incorporated therein.

With reference to FIG. 6, a description is provided of a construction of a driver 46 that drives and rotates the heat shield 28.

FIG. 6 is a partial perspective view of the fixing device 20 illustrating the driver 46. As shown in FIG. 6, the driver 46 includes a motor 42 serving as a driving source and a plurality of gears 43, 44, and 45 constituting a gear train. The gear 43 serving as one end of the gear train is connected to the motor 42. The gear 45 serving as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the heat shield 28 supported by the slider 41.

According to this exemplary embodiment, the driver 46 is connected to one end of the heat shield 28 in the longitudinal direction thereof so that a driving force from the driver 46 is transmitted to one end of the heat shield 28 in the longitudinal direction thereof. Alternatively, the driver 46 may be connected to each end of the heat shield 28 in the longitudinal direction thereof to transmit a driving force to each end of the heat shield 28 in the longitudinal direction thereof. However, the driver 46 connected to one end of the heat shield 28 in the longitudinal direction thereof as shown in FIG. 6 reduces the number of parts constituting the driver 46, reducing manufacturing costs and weight of the fixing device 20. It is to be noted that the driver 46 may be located in either the image forming apparatus 1 depicted in FIG. 1 or the fixing device 20.

With reference to FIG. 2, a description is provided of a fixing operation of the fixing device 20 described above.

As the image forming apparatus 1 depicted in FIG. 1 is powered on, the power supply supplies power to the halogen heater pair 23 and at the same time the driver drives and rotates the pressure roller 22 clockwise in FIG. 2 in the rotation direction R4. Accordingly, the fixing belt 21 rotates counterclockwise in FIG. 2 in the rotation direction R3 in accordance with rotation of the pressure roller 22 by friction between the pressure roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the fixing belt 21 and the pressure roller 22 pressed against the fixing belt 21. The fixing belt 21 heated by the halogen heater pair 23 heats the recording medium P and at the same time the pressure roller 22 pressed against the fixing belt 21, together with the fixing belt 21, exerts pressure on the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of the separator 38, the separator 38 separates the recording medium P from the fixing belt 21. Thereafter, the separated recording medium P is discharged by the output roller pair 13 depicted in FIG. 1 onto the outside of the image forming apparatus 1, that is, the output tray 14 where the recording medium P is stocked.

Figure 7:
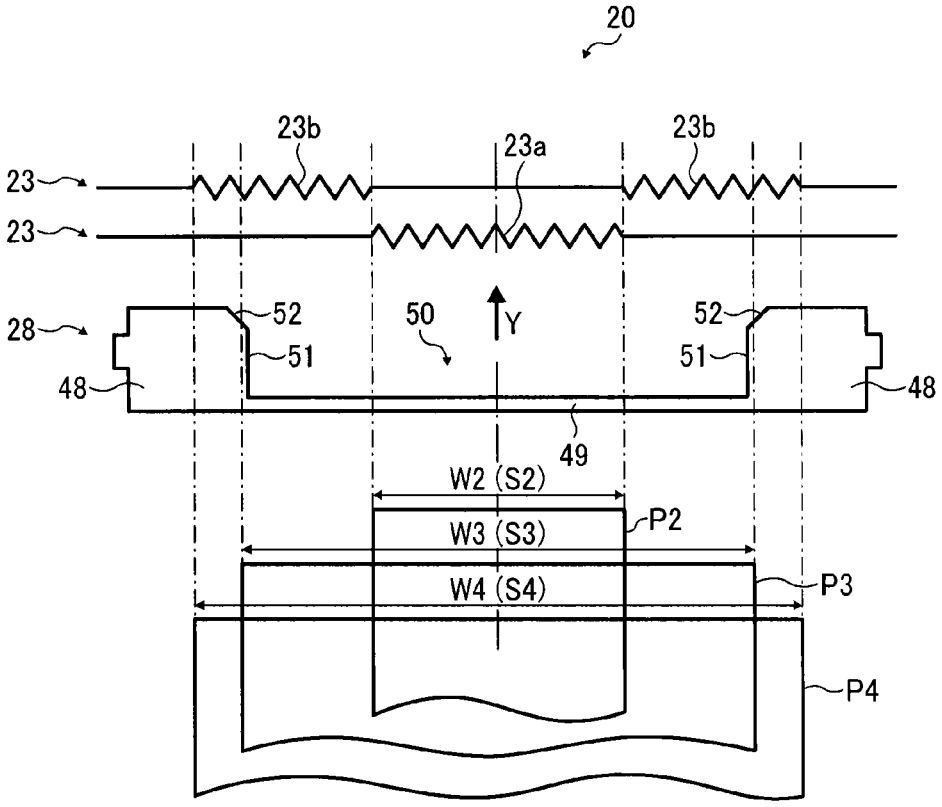
FIG. 7 is a schematic diagram of the fixing device shown in FIG. 3 illustrating a halogen heater pair incorporated therein, the heat shield, and recording media of various sizes.

With reference to FIG. 7, a description is provided of a relation between the shape of the heat shield 28, heat generators of the halogen heater pair 23, and the sizes of recording media.

FIG. 7 is a schematic diagram of the fixing device 20 illustrating the halogen heater pair 23, the heat shield 28, and recording media of various sizes.

First, a detailed description is given of the shape of the heat shield 28.

As shown in FIG. 7, the heat shield 28 includes a pair of shield portions 48 constituting both lateral ends of the heat shield 28 in an axial direction, that is, the longitudinal direction, thereof; a bridge 49 bridging the shield portions 48 in the axial direction of the heat shield 28; and a recess 50 defined by the shield portions 48 and the bridge 49. The shield portions 48 are disposed opposite both lateral ends of the halogen heater pair 23 in a longitudinal direction thereof parallel to the axial direction of the fixing belt 21, respectively, to shield both lateral ends of the fixing belt 21 in the axial direction thereof from the halogen heater pair 23. The recess 50 between the pair of shield portions 48 in the axial direction of the heat shield 28 does not shield the fixing belt 21 from the halogen heater pair 23 and therefore allows light radiated from the halogen heater pair 23 to irradiate the fixing belt 21.

An inboard edge of each shield portion 48 includes a circumferentially straight edge 51 extending parallel to a circumferential direction of the heat shield 28 in which the heat shield 28 rotates and a sloped edge 52 angled relative to the circumferentially straight edge 51. As shown in FIG. 7, the sloped edge 52 is contiguous to the circumferentially straight edge 51 substantially in a shield direction Y in which the heat shield 28 moves from the retracted position shown in FIG. 3 to the shield position shown in FIG. 2. The sloped edge 52 is angled outboard from the circumferentially straight edge 51 substantially in the shield direction Y such that an interval between the sloped edge 52 and another sloped edge 52 increases. Accordingly, the recess 50 has a uniform, decreased width defined by the circumferentially straight edges 51 in the axial direction of the heat shield 28 and an increased width defined by the sloped edges 52 in the axial direction of the heat shield 28 that increases gradually in the shield direction Y.

Next, a detailed description is given of a relation between the heat generators of the halogen heater pair 23 and the sizes of the recording media.

As shown in FIG. 7, the halogen heater pair 23 has a plurality of heat generators having different lengths in the axial direction of the fixing belt 21 and being situated at different positions in the axial direction of the fixing belt 21 to heat different axial spans on the fixing belt 21 according to the size of the recording medium P. For example, the halogen heater pair 23 is constructed of the lower halogen heater 23 having a center heat generator 23*a* disposed opposite a center of the fixing belt 21 in the axial direction thereof and the upper halogen heater 23 having lateral end heat generators 23*b* disposed opposite both lateral ends of the fixing belt 21 in the axial direction thereof, respectively. The center heat generator 23*a* spans a conveyance span S2 corresponding to a width W2 of a medium recording medium P2 in the axial direction of the fixing belt 21. Conversely, the lateral end heat generators 23*b*, together with the center heat generator 23*a*, span a conveyance span S3 corresponding to a width 3 of a large recording medium P3 greater than the width W2 of the medium recording medium P2 and a conveyance span S4 corresponding to a width W4 of an extra-large recording medium P4 greater than the width W3 of the large recording medium P3.

A detailed description is now given of a relation between the shape of the heat shield 28 and the sizes of the recording media P2, P3, and P4.

Each circumferentially straight edge 51 is situated inboard from and in proximity to an edge of the conveyance span S3 corresponding to the width W3 of the large recording medium P3 in the axial direction of the fixing belt 21. Each sloped edge 52 overlaps the edge of the conveyance span S3.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, the medium recording medium P2, the large recording medium P3, and the extra-large recording medium P4 may include recording media of other sizes. Additionally, the medium, large, and extra-large sizes mentioned herein are relative terms. Hence, instead of the medium, large, and extra-large sizes, small, medium, and large sizes may be used.

Figure 8:
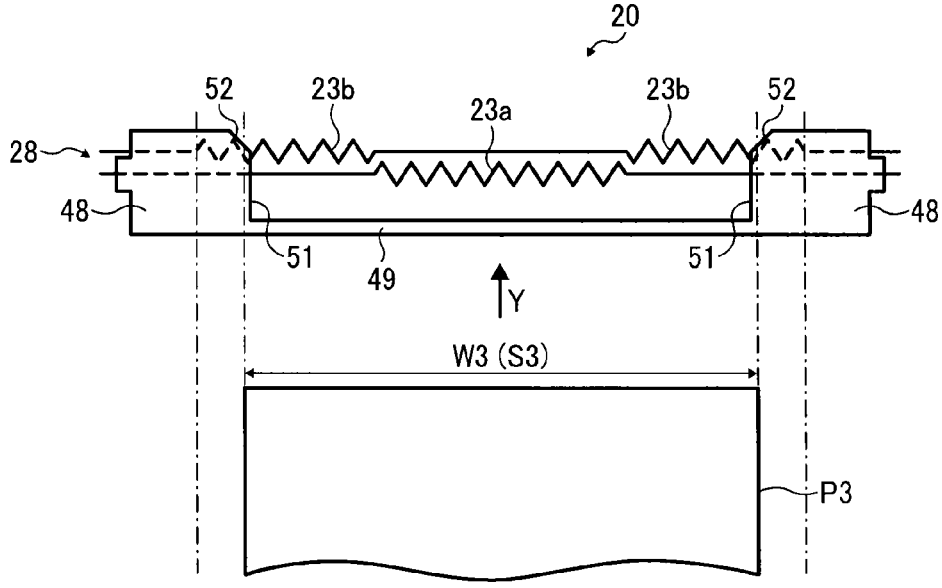
FIG. 8 is a schematic diagram of the fixing device shown in FIG. 2 illustrating the heat shield at the shield position.

With reference to FIGS. 7 and 8, a description is provided of control of the halogen heater pair 23 and the heat shield 28 according to the sizes of recording media.

FIG. 8 is a schematic diagram of the fixing device 20 illustrating the heat shield 28 at the shield position. As the medium recording medium P2 depicted in FIG. 7 is conveyed over the fixing belt 21 depicted in FIG. 2, the controller turns on the center heat generator 23*a* to heat the conveyance span S2 of the fixing belt 21 corresponding to the width W2 of the medium recording medium P2. As the extra-large recording medium P4 is conveyed over the fixing belt 21, the controller turns on the lateral end heat generators 23*b* as well as the center heat generator 28*a* to heat the conveyance span S4 of the fixing belt 21 corresponding to the width W4 of the extra-large recording medium P4.

However, the halogen heater pair 23 is configured to heat the conveyance span S2 corresponding to the width W2 of the medium recording medium P2 and the conveyance span S4 corresponding to the width W4 of the extra-large recording medium P4. Accordingly, if the center heat generator 23*a* is turned on as the large recording medium P3 is conveyed over the fixing belt 21, the center heat generator 23*a* does not heat each outboard span outboard from the conveyance span S2 in the axial direction of the fixing belt 21. Consequently, the large recording medium P3 is not heated throughout the entire width W3 thereof. Conversely, if the lateral end heat generators 23*b* and the center heat generator 23*a* are turned on, the lateral end heat generators 23*b* may heat both outboard spans outboard from the conveyance span S3 in the axial direction of the fixing belt 21 corresponding to the width W3 of the large recording medium P3. If the large recording medium P3 is conveyed over the fixing belt 21 while the lateral end heat generators 23*b* and the center heat generator 23*a* are turned on, the lateral end heat generators 23*b* may heat both outboard spans outboard from the conveyance span S3 in the axial direction of the fixing belt 21 corresponding to the width W3 of the large recording medium P3, resulting in overheating of the fixing belt 21 in the outboard spans outboard from the conveyance span S3 where the large recording medium P3 is not conveyed over the fixing belt 21.

To address this circumstance, as the large recording medium P3 is conveyed over the fixing belt 21, the heat shield 28 moves to the shield position as shown in FIG. 8. At the shield position shown in FIG. 8, the shield portions 48 of the heat shield 28 shield the fixing belt 21 in a span in proximity to both side edges of the large recording medium P3 and the outboard spans outboard from the conveyance span S3, thus suppressing overheating of the fixing belt 21 in the outboard spans outboard from the conveyance span S3 where the large recording medium P3 is not conveyed over the fixing belt 21.

When a fixing job is finished or the temperature of the outboard spans outboard from the conveyance span S3 of the fixing belt 21 where the large recording medium P3 is not conveyed over the fixing belt 21 decreases to a predetermined threshold and therefore the heat shield 28 is no longer requested to shield the fixing belt 21, the controller moves the heat shield 28 to the retracted position shown in FIG. 3. Thus, the fixing device 20 performs the fixing job precisely by moving the heat shield 28 to the shield position shown in FIG. 2 at a proper time without decreasing the rotation speed of the fixing belt 21 and the pressure roller 22 to convey the large recording medium P3.

Since each shield portion 48 includes the sloped edge 52 as shown in FIG. 7, as the rotation angle of the heat shield 28 changes, the shield portions 48 shield the fixing belt 21 from the lateral end heat generators 23*b* in a variable area. For example, if the number of recording media conveyed through the fixing nip N and a conveyance time for which the recording media are conveyed through the fixing nip N increase, the fixing belt 21 is subject to overheating in a non-conveyance span (e.g., the outboard spans outboard from the conveyance spans S2 and S3) where the recording media are not conveyed over the fixing belt 21. To address this circumstance, when the number of recording media conveyed through the fixing nip N reaches a predetermined number or when the conveyance time reaches a predetermined conveyance time, the controller moves the heat shield 28 in the shield direction Y to the shield position shown in FIG. 2 where the shield portions 48 are disposed opposite the lateral end heat generators 23*b*, respectively, suppressing overheating of the fixing belt 21 precisely.

Figure 9:
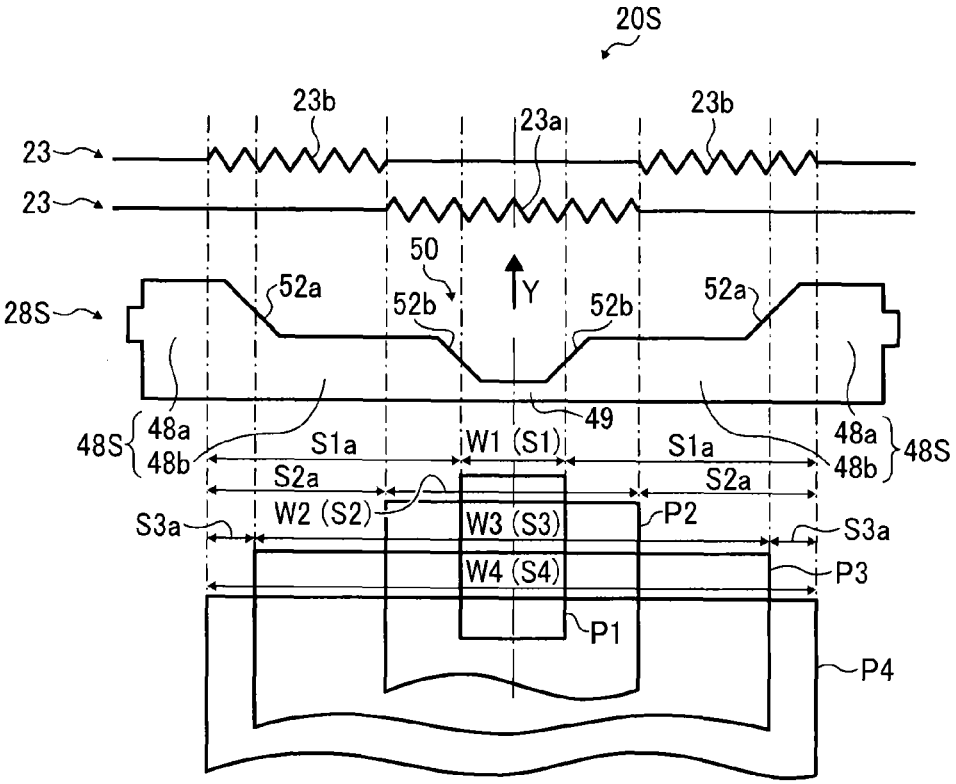
FIG. 9 is a schematic diagram of a fixing device according to another exemplary embodiment.
Figure 10:
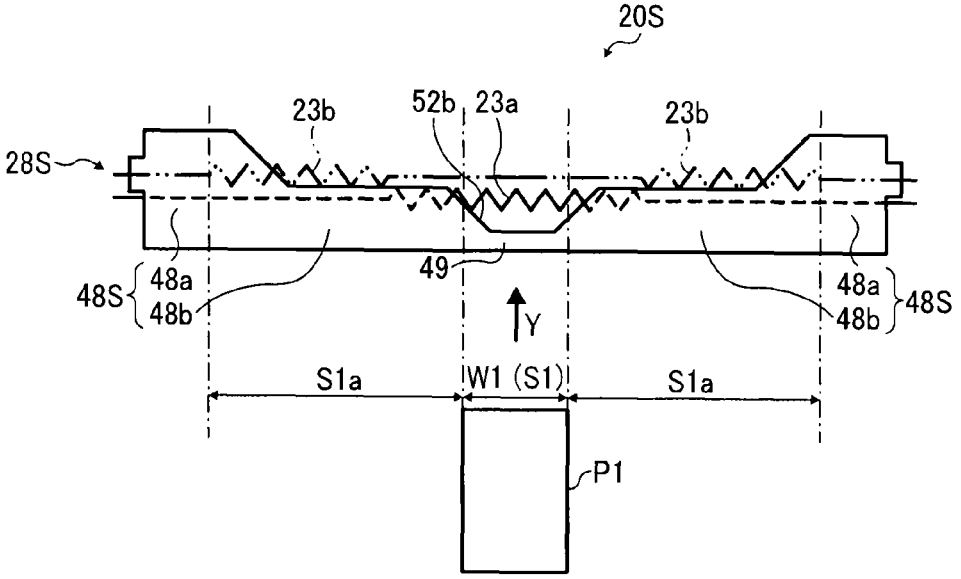
FIG. 10 is a schematic diagram of the fixing device shown in FIG. 9 illustrating a heat shield incorporated therein that is situated at the shield position.

With reference to FIGS. 9 and 10, a description is provided of a configuration of a fixing device 20S incorporating a heat shield 28S according to another exemplary embodiment.

FIG. 9 is a schematic diagram of the fixing device 20S. FIG. 10 is a schematic diagram of the fixing device 20S illustrating the heat shield 28S at the shield position. As shown in FIG. 9, the heat shield 28S includes a pair of shield portions 48S disposed at both lateral ends of the heat shield 28S in an axial direction thereof, respectively. Each of the shield portions 48S has two steps. For example, each shield portion 48S includes an outboard, small shield section 48*a* having a decreased length in a longitudinal direction of the heat shield 28S parallel to the axial direction thereof and an inboard, great shield section 48*b* having an increased length in the longitudinal direction of the heat shield 28S. The bridge 49 bridges the great shield section 48*b* of one shield portion 48S situated at one lateral end of the heat shield 28S and the great shield section 48*b* of another shield portion 48S situated at another lateral end of the heat shield 28S in the axial direction thereof. The small shield section 48*a* is contiguous to the great shield section 48*b* substantially in the shield direction Y. A sloped edge 52*a*, that is, an inboard edge of the small shield section 48*a* in the axial direction of the heat shield 28S, is disposed opposite another sloped edge 52*a*, that is, an inboard edge of another small shield section 48*a* in the axial direction of the heat shield 28S. Similarly, a sloped edge 52*b*, that is, an inboard edge of the great shield section 48*b* in the axial direction of the heat shield 28S, is disposed opposite another sloped edge 52*b*, that is, an inboard edge of another great shield section 48*b* in the axial direction of the heat shield 28S. The two sloped edges 52*b* of the great shield sections 48*b* are angled relative to the bridge 49 such that an interval between the two sloped edges 52*b* in the axial direction of the heat shield 28S increases gradually in the shield direction Y. Similarly, the two sloped edges 52*a* of the small shield sections 48*a* are angled relative to the bridge 49 such that an interval between the two sloped edges 52*a* in the axial direction of the heat shield 28S increases gradually in the shield direction Y. Unlike the heat shield 28 depicted in FIG. 7, the heat shield 28S does not incorporate the circumferentially straight edges 51.

At least four sizes of recording media, including a small recording medium P1, a medium recording medium P2, a large recording medium P3, and an extra-large recording medium P4, are available in the fixing device 20S. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator 23*a* in the longitudinal direction of the halogen heater pair 23 parallel to the axial direction of the heat shield 28S. The sloped edge 52*b* of the great shield section 48*b* overlaps a side edge of the small recording medium P1. The sloped edge 52*a* of the small shield section 48*a* overlaps a side edge of the large recording medium P3. It is to be noted that a description of the relation between the position of recording media other than the small recording medium P1, that is, the medium recording medium P2, the large recording medium P3, and the extra-large recording medium P4, and the position of the center heat generator 23*a* and the lateral end heat generators 23*b* of the fixing device 20S is omitted because it is similar to that of the fixing device 20 described above. As shown in FIG. 9, compared to the width W4, the width W1 of the small recording medium P1 leaves gaps of length S1*a* on esch side. Similarly, for recording media P2 and P3, the gaps are S2*a*, respectively.

As the small recording medium P1 is conveyed through the fixing nip N, the center heat generator 23*a* is turned on. However, since the center heat generator 23*a* heats the conveyance span S2 of the fixing belt 21 corresponding to the width W2 of the medium recording medium P2 that is greater than the width W1 of the small recording medium P1, the controller moves the heat shield 28S to the shield position shown in FIG. 10. At the shield position shown in FIG. 10, each great shield section 48*b* of the heat shield 28S shields the fixing belt 21 from the center heat generator 23*a* in an outboard span outboard from a conveyance span S1 corresponding to the width W1 of the small recording medium P1 in the axial direction of the fixing belt 21. Accordingly, the fixing belt 21 does not overheat in each outboard span outboard from the conveyance span S1 where the small recording medium P1 is not conveyed over the fixing belt 21.

As the medium recording medium P2, the large recording medium P3, and the extra-large recording medium P4 are conveyed through the fixing nip N, the controller performs a control for controlling the halogen heater pair 23 and the heat shield 28S that is similar to the control for controlling the halogen heater pair 23 and the heat shield 28 described above. In this case, each small shield section 48*a* of the heat shield 28S shields the fixing belt 21 from the halogen heater pair 23 as each shield portion 48 of the fixing device 20 does.

Like the shield portion 48 of the fixing device 20 that has the sloped edge 52, the small shield section 48*a* and the great shield section 48*b* have the sloped edges 52*a* and 52*b*, respectively. Accordingly, by changing the rotation angled position of the heat shield 28S, the controller changes the span of the fixing belt 21 shielded from the center heat generator 23*a* and the lateral end heat generators 23*b* of the halogen heater pair 23 by the small shield section 48*a* and the great shield section 48*b* of each shield portion 48S.

Figure 11:
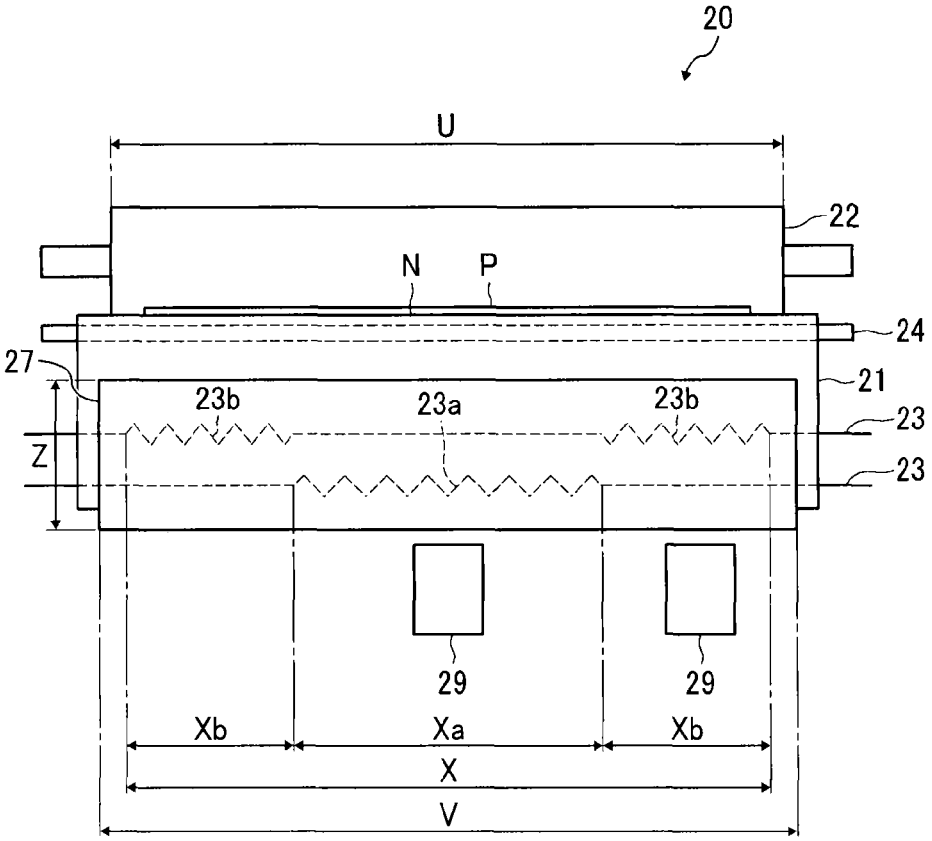
FIG. 11 is a plan view of the fixing device shown in FIG. 2 seen in a direction V1 in FIG. 2.

With reference to FIG. 11, a description is provided of a configuration of the exterior reflector 27.

FIG. 11 is a plan view of the fixing device 20 seen in a direction V1 in FIG. 2. As shown in FIG. 11, the fixing device 20 includes two temperature sensors 29 disposed opposite the center heat generator 23*a* and one of the two lateral end heat generators 23*b*, that is, the right lateral end heat generator 23*b*, respectively.

An axial length V of the exterior reflector 27 in the axial direction of the fixing belt 21 is greater than an axial heating span X of the halogen heater pair 23, that is, a combined length of an axial heating span of the center heat generator 23*a* and two axial heating spans of the lateral end heat generators 23*b*, in the axial direction of the fixing belt 21. Hence, the exterior reflector 27 reflects heat radiated from the fixing belt 21 thereto back onto the fixing belt 21 effectively. The axial length V of the exterior reflector 27 is greater than a fixing nip length U of the fixing nip N in the axial direction of the fixing belt 21. Accordingly, the exterior reflector 27 having the axial length V that is greater than the axial heating span X of the halogen heater pair 23 and the fixing nip length U of the fixing nip N reflects heat radiated from the fixing belt 21 back onto the fixing belt 21 throughout the entire fixing nip length U of the fixing nip N, suppressing variation in temperature of the fixing belt 21 throughout the entire fixing nip length U of the fixing nip N.

As shown in FIG. 2, the exterior reflector 27 includes an arcuate reflection face 27*a* disposed opposite the outer circumferential surface of the fixing belt 21. A circumferential length Z, that is, a circumferential span, of the exterior reflector 27 in the circumferential direction of the fixing belt 21 depicted in FIG. 2 corresponds to a circumferential length of the reflection face 27*a* of the exterior reflector 27. The circumferential length Z of the exterior reflector 27 is even throughout the axial heating span X of the halogen heater pair 23 depicted in FIG. 11. Accordingly, the exterior reflector 27 reflects heat radiated from the fixing belt 21 back onto the fixing belt 21 evenly throughout the entire axial length of the fixing belt 21, suppressing variation in temperature of the fixing belt 21.

As shown in FIG. 11, the circumferential length Z of the exterior reflector 27 may be even in each of a center axial heating span Xa of the center heat generator 23*a* and lateral end axial heating spans Xb of the lateral end heat generators 23*b*. For example, according to a relative positional relation between the center heat generator 23*a* and the lateral end heat generators 23*b*, the circumferential length Z of the exterior reflector 27 may be different or identical among the center axial heating span Xa of the center heat generator 23*a* and the lateral end axial heating spans Xb of the lateral end heat generators 23*b*.

Additionally, as shown in FIG. 2, the reflection face 27*a* of the exterior reflector 27 is spaced apart from the outer circumferential surface of the fixing belt 21 with a gap G that is even throughout the entire reflection face 27*a* of the exterior reflector 27, suppressing variation in temperature of the fixing belt 21 in the circumferential direction and the axial direction of the fixing belt 21.

A description is provided of the position of the exterior reflector 27.

Unlike a resistance heat generator such as a ceramic heater that heats the fixing belt 21 locally, heat radiated from the halogen heater pair 23 diffuses in the circumferential direction of the fixing belt 21. For example, heat from the halogen heater pair 23 diffuses to the nip formation assembly 24 and the stay 25 situated inside the loop formed by the fixing belt 21. If the heat conducted to the nip formation assembly 24 and the stay 25 dissipates without being conducted to the fixing belt 21 to fix the toner image T on the recording medium P, heat from the halogen heater pair 23 is wasted.

On the other hand, since the stay 25 has a relatively great thermal capacity compared to other components situated inside the fixing belt 21, the stay 25 stores heat from the halogen heater pair 23. Accordingly, in order to use heat stored in the stay 25 efficiently, the exterior reflector 27 is disposed opposite the fixing belt 21 at a position where the stay 25 is in proximity to the fixing belt 21, that is, at a position where the fixing belt 21 is spaced apart from the stay 25 with a decreased interval therebetween. For example, since the stay 25 is close to an upper part of the fixing belt 21 in FIG. 2, the exterior reflector 27 is disposed opposite the upper part of the fixing belt 21.

The exterior reflector 27 spans in the circumferential direction of the fixing belt 21 in a circumferential span having the circumferential length Z where the fixing belt 21 is in proximity to the stay 25 or spaced apart from the stay 25 with the decreased interval therebetween. Hence, the exterior reflector 27 is close to the stay 25 that stores a relatively great amount of heat. Accordingly, the exterior reflector 27 reflects heat radiated from the stay 25 onto the fixing belt 21 effectively, resulting in effective use of heat.

As the halogen heater pair 23 is turned off, the temperature of the fixing belt 21 decreases sharply. To address this circumstance, according to this exemplary embodiment, even after the halogen heater pair 23 is turned off, the exterior reflector 27 causes heat stored in the stay 25 to be conducted to the fixing belt 21, suppressing temperature decrease of the fixing belt 21. Accordingly, the fixing belt 21 is warmed up quickly upon receipt of a next fixing job. During the fixing job also, the exterior reflector 27 reflects heat radiated from the stay 25 onto the fixing belt 21, saving energy.

Since the heat shield 28 is located inside the fixing belt 21, heat radiated from the heat shield 28 is also used to heat the fixing belt 21. For example, as shown in FIGS. 2 and 3, the exterior reflector 27 overlaps or is disposed opposite the heat shield 28 at least partially in the circumferential direction and the axial direction of the fixing belt 21. Accordingly, the exterior reflector 27 reflects heat radiated from the heat shield 28 onto the fixing belt 21.

Since the heat shield 28 is movable in the circumferential direction of the fixing belt 21, as the heat shield 28 moves, the heat shield 28 overlaps the exterior reflector 27 in a variable circumferential span in the circumferential direction of the fixing belt 21. As shown in FIG. 3, when the heat shield 28 is at the retracted position where the heat shield 28 is disposed opposite the halogen heater pair 23 via the stay 25 or behind the stay 25 to escape light from the halogen heater pair 23, the heat shield 28 overlaps the exterior reflector 27 in an increased circumferential span of the heat shield 28. Conversely, when the heat shield 28 is at the shield position shown in FIG. 2, the heat shield 28 overlaps the exterior reflector 27 in a decreased circumferential span of the heat shield 28. However, in order to use heat more effectively, whether the heat shield 28 moves to the retracted position shown in FIG. 3 or the shield position shown in FIG. 2, the heat shield 28 overlaps the exterior reflector 27 at least partially. Even if the heat shield 28 moves to a shield position where the heat shield 28 does not overlap the exterior reflector 27, the heat shield 28 overlaps the exterior reflector 27 at least at the retracted position where the exterior reflector 27 reflects heat radiated from the heat shield 28 onto the fixing belt 21, thus using radiation heat effectively.

Figure 12:
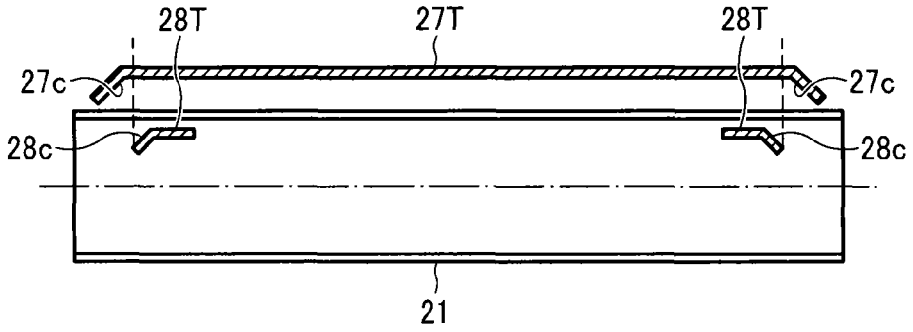
FIG. 12 is a sectional view of an exterior reflector and a heat shield as a variation of the exterior reflector and the heat shield shown in FIG. 2.

With reference to FIG. 12, a description is provided of a variation of the exterior reflector 27 and the heat shield 28.

FIG. 12 is a sectional view of an exterior reflector 27T and a heat shield 28T as a variation of the exterior reflector 27 and the heat shield 28 shown in FIG. 2. As shown in FIG. 12, the heat shield 28T includes a slope 28*c* angled relative to the axial direction of the fixing belt 21 at each lateral end of the heat shield 28T in a longitudinal direction thereof parallel to the axial direction of the fixing belt 21. Similarly, the exterior reflector 27T includes a slope 27*c* angled relative to the axial direction of the fixing belt 21 at each lateral end of the exterior reflector 27T in a longitudinal direction thereof parallel to the axial direction of the fixing belt 21 such that the slope 27*c* of the exterior reflector 27T corresponds to the slope 28*c* of the heat shield 28T. That is, the slope 27*c* of the exterior reflector 27T is disposed opposite the slope 28*c* of the heat shield 28T at each lateral end of the exterior reflector 27T and the heat shield 28T in the axial direction of the fixing belt 21. Accordingly, the slopes 27*c* of the exterior reflector 27T are closer to the slopes 28*c* of the heat shield 28T than the exterior reflector 27 without the slopes 27*c*. Consequently, the exterior reflector 27T reflects heat radiated from the heat shield 28T onto the fixing belt 21 effectively. It is to be noted that the slopes 27*c* of the exterior reflector 27T may not overlap the slopes 28*c* of the heat shield 28T. For example, the slopes 27*c* of the exterior reflector 27T may merely be disposed opposite the slopes 28*c* of the heat shield 28T via the fixing belt 21. That is, as long as the exterior reflector 27T reflects heat radiated from the heat shield 28T onto the fixing belt 21, the exterior reflector 27T may not overlap the heat shield 28T in the circumferential direction and the axial direction of the fixing belt 21.

As shown in FIG. 2, the separator 38, the exterior reflector 27, the temperature sensor 29, and the abnormal temperature detector 37 are arranged in this order in the rotation direction R3 of the fixing belt 21 along a circumferential span of the fixing belt 21 originating at an exit of the fixing nip N and terminating at an entry to the fixing nip N such that the separator 38, the exterior reflector 27, the temperature sensor 29, and the abnormal temperature detector 37 do not interfere with each other. FIG. 2 illustrates the exterior reflector 27 disposed adjacent to the temperature sensor 29. It is preferable that the exterior reflector 27 and the temperature sensor 29 are located at different positions in the circumferential direction of the fixing belt 21, respectively, that is, the exterior reflector 27 does not overlap the temperature sensor 29 in the circumferential direction of the fixing belt 21 or the exterior reflector 27 is spaced apart from the temperature sensor 29 in the circumferential direction of the fixing belt 21.

Figure 13:
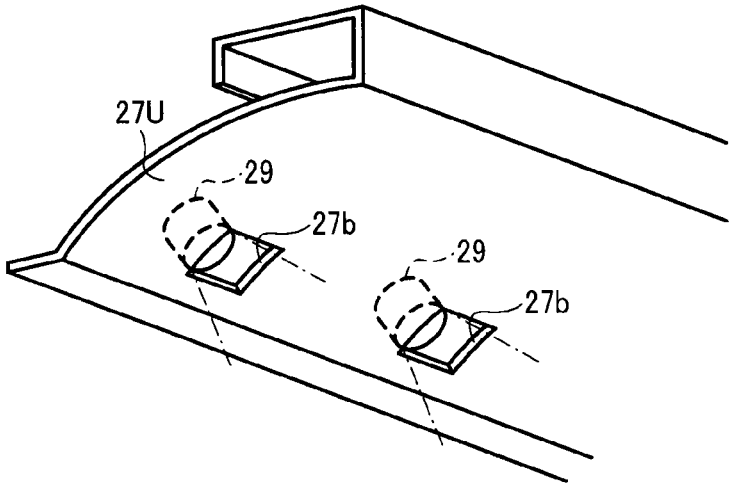
FIG. 13 is a partial perspective view of an exterior reflector produced with a plurality of slots as another variation of the exterior reflector shown in FIG. 2.

If the exterior reflector 27 and the temperature sensor 29 are located at an identical position in the circumferential direction of the fixing belt 21 or the exterior reflector 27 overlaps the temperature sensor 29, it is necessary to produce a slot in the exterior reflector 27 through which the temperature sensor 29 detects the temperature of the outer circumferential surface of the fixing belt 21 as shown in FIG. 13. FIG. 13 is a partial perspective view of an exterior reflector 27U produced with a plurality of slots 27*b* disposed opposite the plurality of temperature sensors 29, respectively. However, the slot 27*b* may not reflect heat, varying the temperature of the fixing belt 21 in the axial direction thereof. To address this circumstance, the exterior reflector 27 is spaced apart from the temperature sensor 29 in the circumferential direction of the fixing belt 21 as shown in FIG. 2. Accordingly, the exterior reflector 27 prevents variation in temperature of the fixing belt 21 in the axial direction thereof even without the slots 27*b*.

FIG. 2 illustrates the fixing device 20 incorporating the movable heat shield 28. Alternatively, the fixing device 20 may incorporate a stationary heat shield described below.

With reference to FIGS. 14 to 17, a description is provided of a configuration of a fixing device 20V incorporating a stationary heat shield 28V as a first example.

Figure 14:
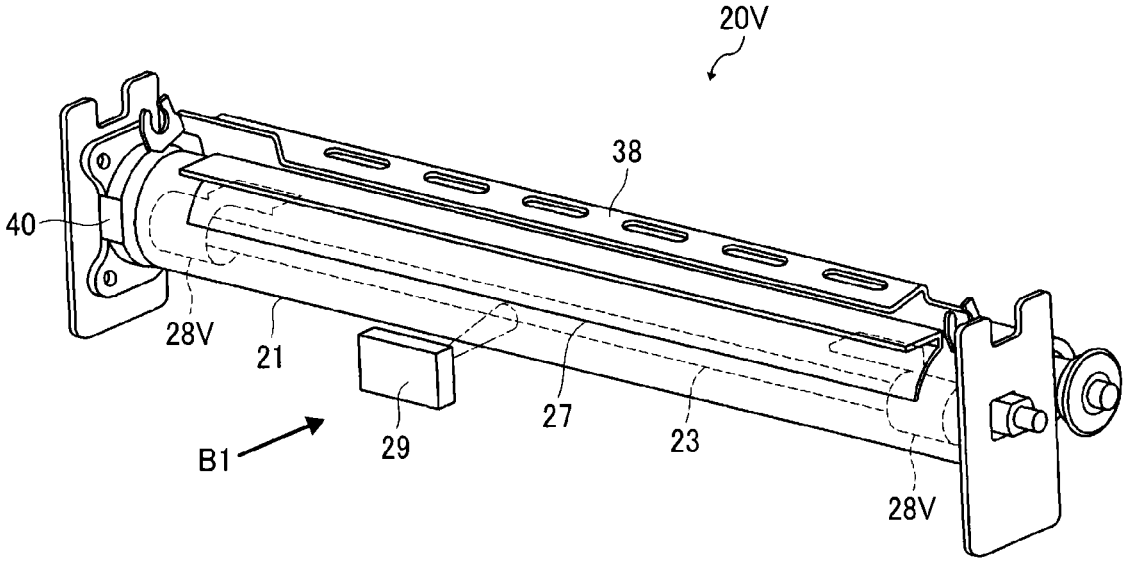
FIG. 14 is a partial perspective view of a fixing device according to another exemplary embodiment.
Figure 15:
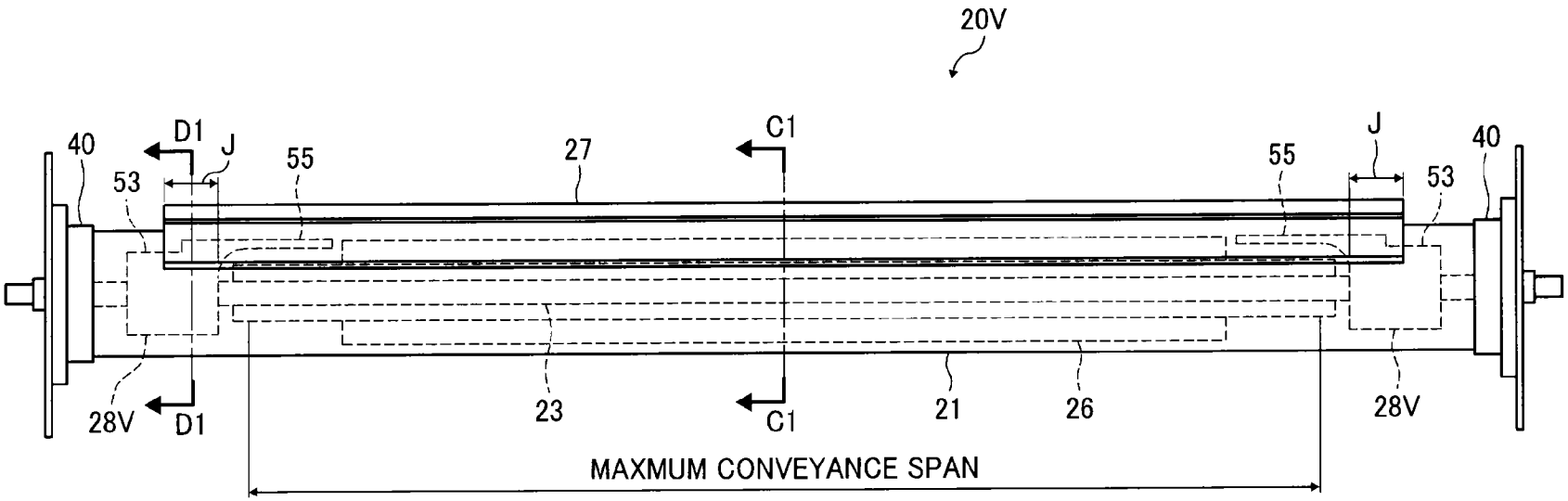
FIG. 15 is a side view of the fixing device shown in FIG. 14 seen in a direction B1 in FIG. 14.
Figure 16:
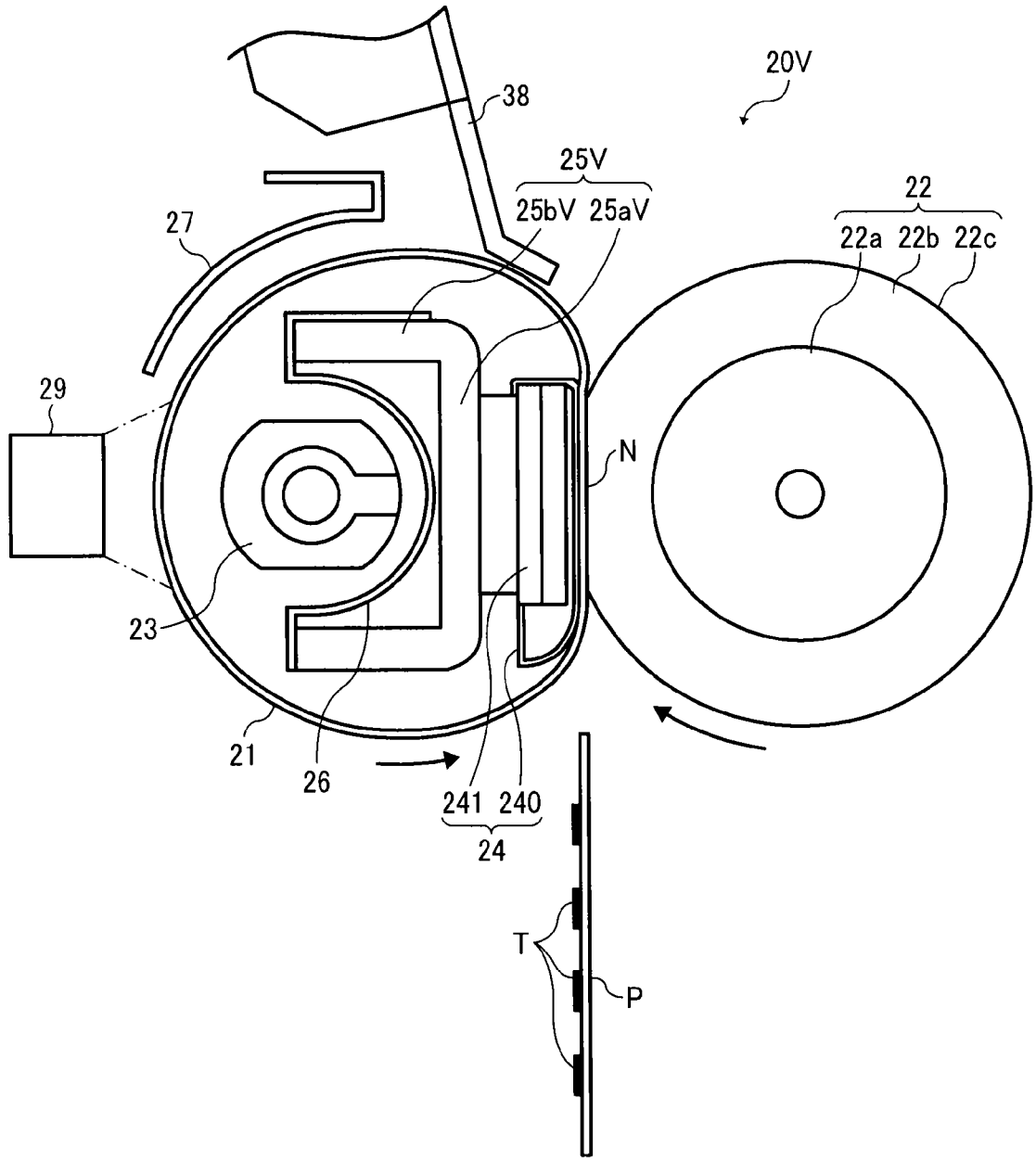
FIG. 16 is a vertical sectional view of the fixing device shown in FIG. 15 taken along line C1-C1 of FIG. 15.
Figure 17:
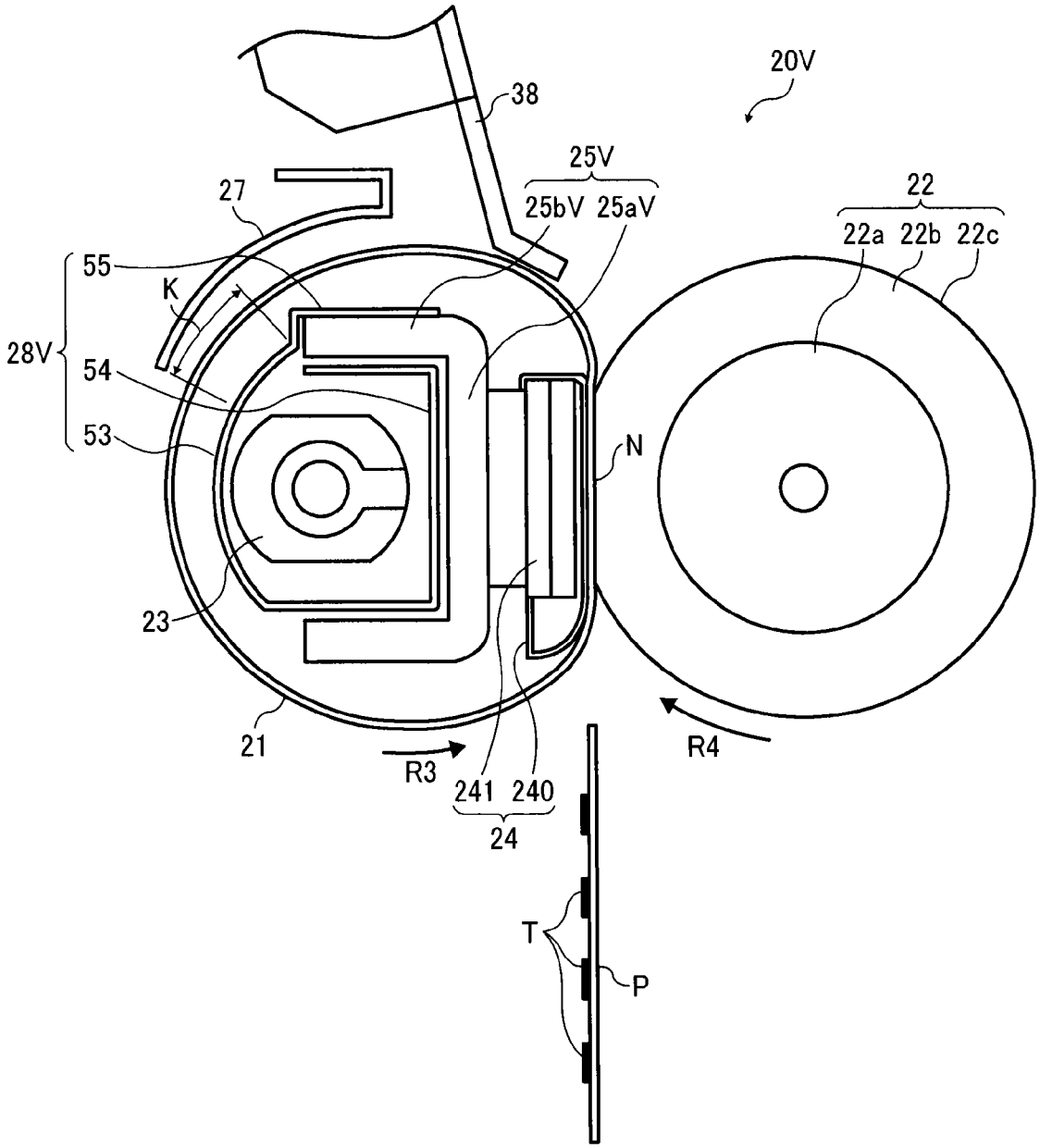
FIG. 17 is a vertical sectional view of the fixing device shown in FIG. 15 taken along line D1-D1 of FIG. 15.

FIG. 14 is a partial perspective view of the fixing device 20V incorporating the stationary heat shield 28V. FIG. 15 is a side view of the fixing device 20V seen in a direction B1 in FIG. 14. FIG. 16 is a vertical sectional view of the fixing device 20V taken along line C1-C1 of FIG. 15 at a center of the fixing belt 21 in the axial direction thereof. FIG. 17 is a vertical sectional view of the fixing device 20V taken along line D1-D1 of FIG. 15 at a lateral end of the fixing belt 21 in the axial direction thereof.

As shown in FIGS. 14 and 15, the fixing device 20V includes two heat shields 28V disposed opposite both lateral ends of the fixing belt 21 in the axial direction thereof, respectively. As shown in FIG. 17, each heat shield 28V includes a first shield portion 53 interposed between a halogen heater 23 and the fixing belt 21; a second shield portion 54 interposed between the halogen heater 23 and a stay 25V; and a mounted portion 55 mounted on the stay 25V.

The first shield portion 53 is curved into an arc along the inner circumferential surface of the fixing belt 21 to shield the fixing belt 21 from the halogen heater 23. As shown in FIG. 15, the first shield portion 53 is disposed opposite a non-conveyance span of the fixing belt 21 outboard from a maximum conveyance span of the fixing belt 21 in the axial direction thereof where the maximum recording medium is conveyed. The first shield portion 53 disposed opposite the non-conveyance span of the fixing belt 21 shields the fixing belt 21 from the halogen heater 23 in the non-conveyance span of the fixing belt 21, suppressing overheating of the non-conveyance span of the fixing belt 21.

As shown in FIG. 17, the second shield portion 54 adjoins one end of the first shield portion 53 in a circumferential direction thereof, that is, a lower end of the first shield portion 53. The second shield portion 54 is folded into three planes along an inner face of the stay 25V. Like the first shield portion 53, the second shield portion 54 is disposed opposite the non-conveyance span of the fixing belt 21 where the maximum recording medium is not conveyed. The second shield portion 54 disposed opposite the non-conveyance span of the fixing belt 21 shields the stay 25V from the halogen heater 23 at each lateral end of the stay 25V in a longitudinal direction thereof parallel to the axial direction of the fixing belt 21.

The stay 25V is constructed of a base 25*a*V and upper and lower arms 25*b*V projecting from the base 25*a*V. The mounted portion 55 adjoins another end of the first shield portion 53 in the circumferential direction thereof, that is, an upper end of the first shield portion 53. The mounted portion 55 is fastened to an upper face of the upper arm 25*b*V of the stay 25V with a screw or the like. Thus, the heat shield 28V is mounted on the stay 25V.

The first shield portion 53 partially overlaps the exterior reflector 27 in the circumferential direction and the axial direction of the fixing belt 21. For example, as shown in FIG. 15, the first shield portion 53 partially overlaps the exterior reflector 27 in an overlap span J in the axial direction of the fixing belt 21. As shown in FIG. 17, the first shield portion 53 partially overlaps the exterior reflector 27 in an overlap span K in the circumferential direction of the fixing belt 21. Since the first shield portion 53 overlaps the exterior reflector 27 in the overlap spans J and K, the exterior reflector 27 reflects heat radiated from the first shield portion 53 onto the fixing belt 21, achieving effective use of heat.

With reference to FIGS. 18 to 21, a description is provided of a configuration of a fixing device 20W incorporating the stationary heat shields 28V as a second example.

Figure 18:
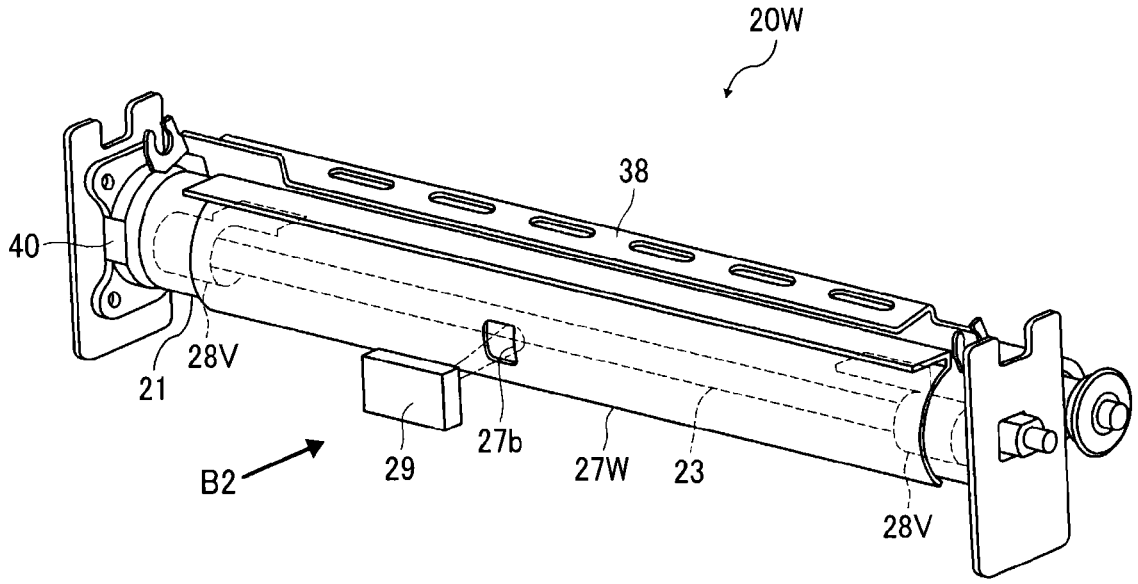
FIG. 18 is a partial perspective view of a fixing device according to yet another exemplary embodiment.
Figure 19:
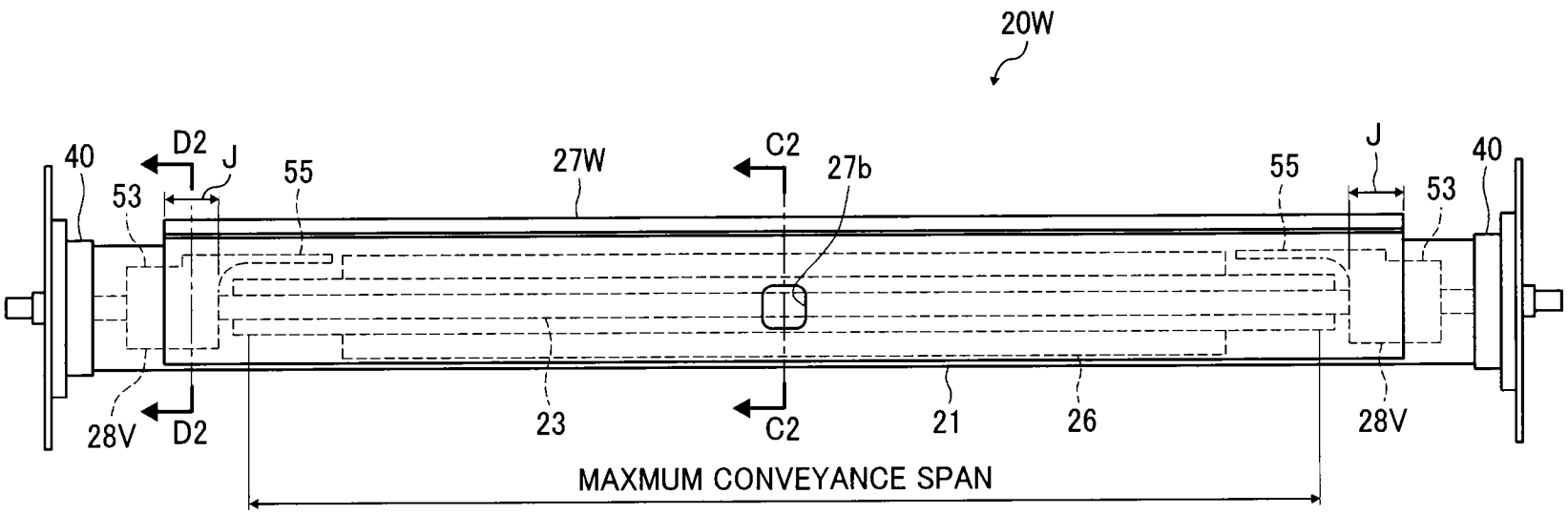
FIG. 19 is a side view of the fixing device shown in FIG. 18 seen in a direction B2 in FIG. 18.
Figure 20:
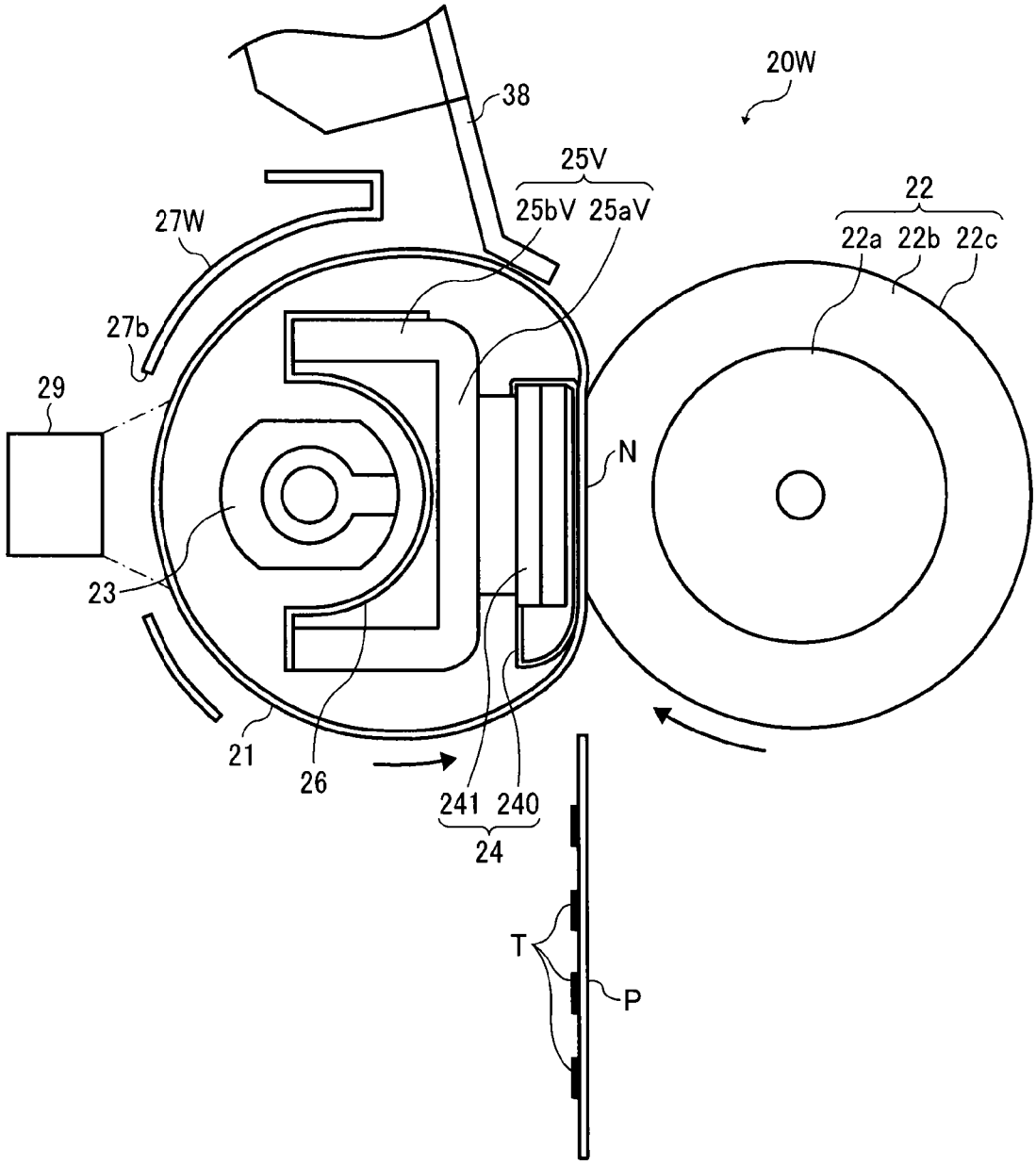
FIG. 20 is a vertical sectional view of the fixing device shown in FIG. 19 taken along line C2-C2 of FIG. 19.
Figure 21:
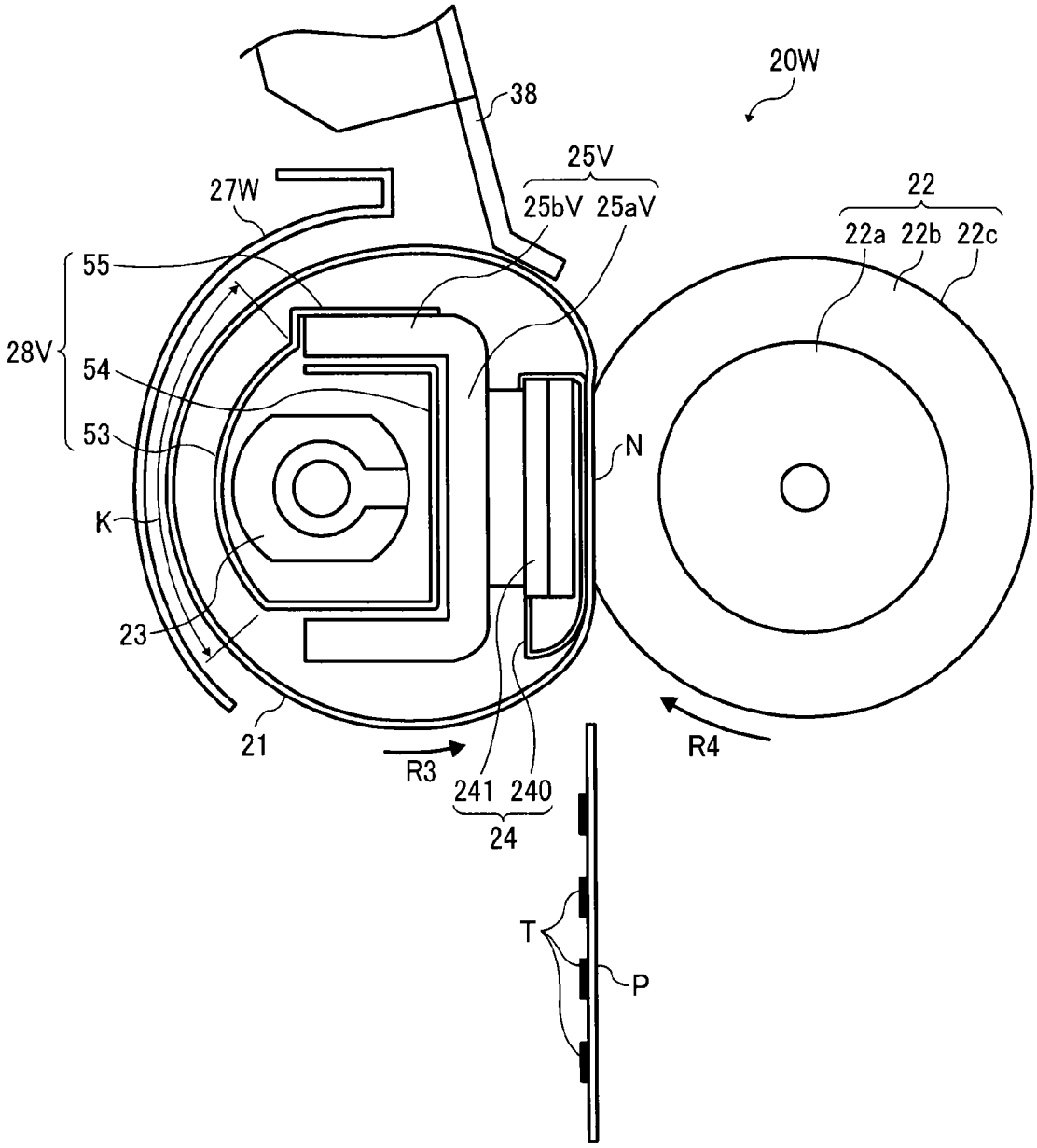
FIG. 21 is a vertical sectional view of the fixing device shown in FIG. 19 taken along line D2-D2 of FIG. 19.

FIG. 18 is a partial perspective view of the fixing device 20W incorporating the stationary heat shields 28V. FIG. 19 is a side view of the fixing device 20W seen in a direction B2 in FIG. 18. FIG. 20 is a vertical sectional view of the fixing device 20W taken along line C2-C2 of FIG. 19 at the center of the fixing belt 21 in the axial direction thereof. FIG. 21 is a vertical sectional view of the fixing device 20W taken along line D2-D2 of FIG. 19 at the lateral end of the fixing belt 21 in the axial direction thereof.

As shown in FIG. 21, the fixing device 20W includes an exterior reflector 27W that is greater than the exterior reflector 27 shown in FIG. 17 in the circumferential direction of the fixing belt 21. For example, the exterior reflector 27 shown in FIG. 17 spans from an upper part of the fixing belt 21 to a position upstream from an intermediate part interposed between the upper part and a lower part of the fixing belt 21 in the rotation direction R3 of the fixing belt 21. Contrarily, the exterior reflector 27W shown in FIG. 21 spans from the upper part of the fixing belt 21 to a position upstream from the lower part of the fixing belt 21 in the rotation direction R3 of the fixing belt 21 through the intermediate part of the fixing belt 21. The exterior reflector 27W having an increased length in the circumferential direction of the fixing belt 21 reflects heat radiated from the fixing belt 21 in an increased circumferential span thereof. Additionally, the exterior reflector 27W overlaps the stationary heat shield 28V in an increased overlap span K in the circumferential direction of the fixing belt 21, achieving more effective use of heat. For example, as shown in FIG. 18, the exterior reflector 27W overlaps the first shield portion 53 of the stationary heat shield 28V substantially entirely in the circumferential direction of the fixing belt 21.

However, the exterior reflector 27W having the increased length in the circumferential direction of the fixing belt 21 overlaps a detection position of the temperature sensor 29. To address this circumstance, as shown in FIG. 18, the exterior reflector 27W includes the slot 27*b* at a center of the exterior reflector 27W in a longitudinal direction thereof parallel to the axial direction of the fixing belt 21. Thus, the temperature sensor 29 detects the temperature of the outer circumferential surface of the fixing belt 21 through the slot 27*b*. A description of a configuration of other components incorporated in the fixing device 20W is omitted because it is similar to that of the fixing device 20V shown in FIGS. 14 to 17.

With reference to FIGS. 22 to 25, a description is provided of a configuration of a fixing device 20X incorporating the stationary heat shields 28V as a third example.

Figure 22:
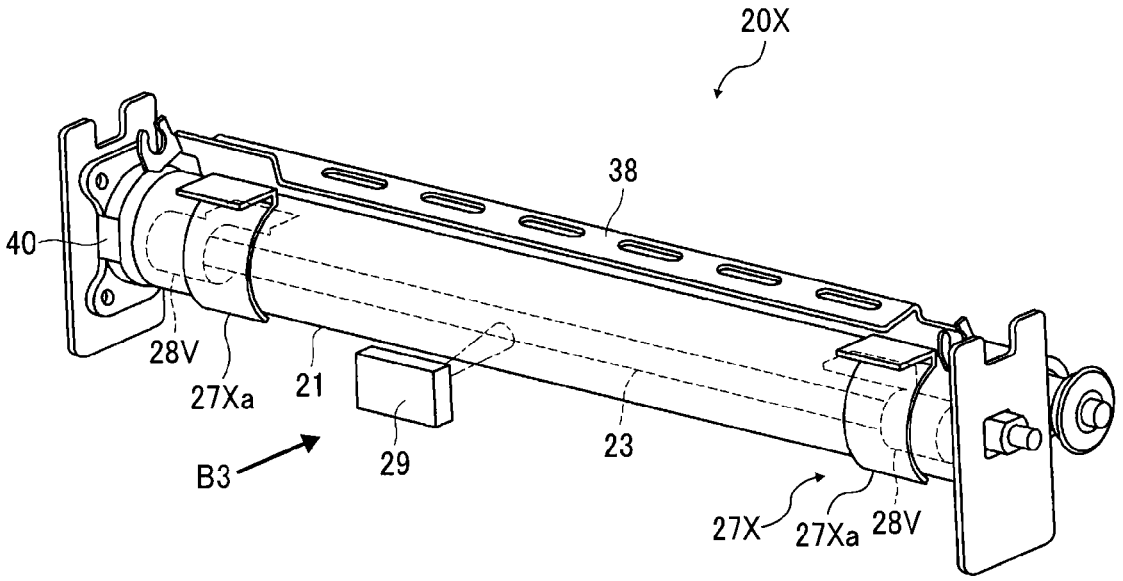
FIG. 22 is a partial perspective view of a fixing device according to yet another exemplary embodiment.
Figure 23:
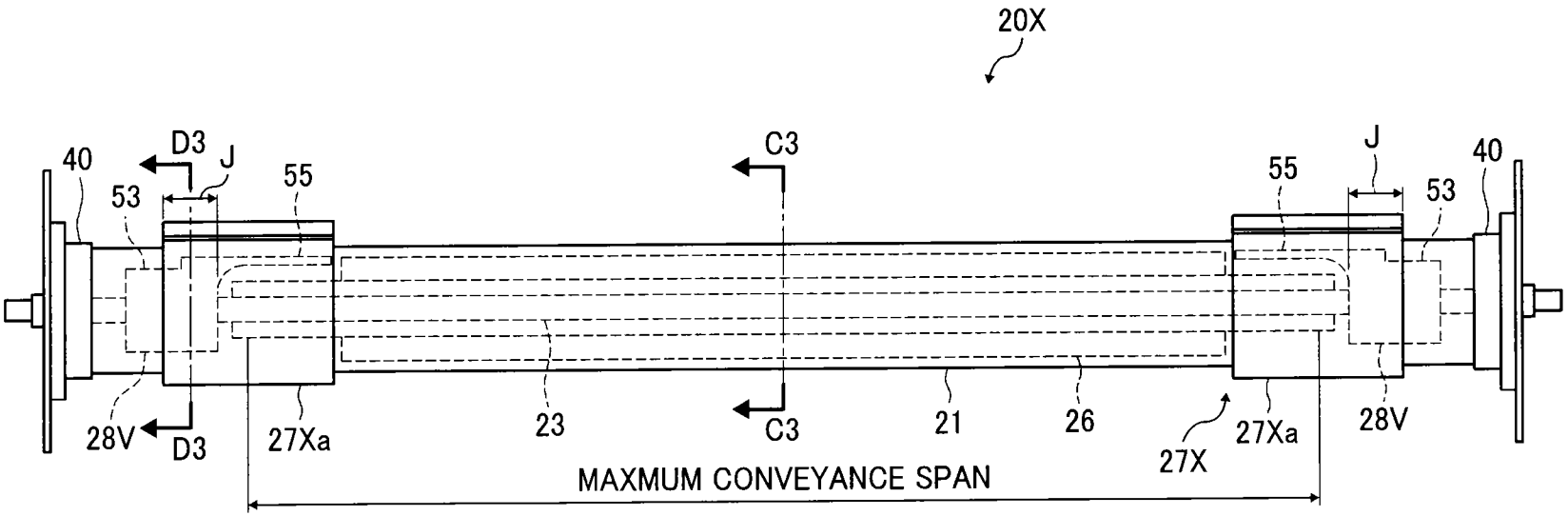
FIG. 23 is a side view of the fixing device shown in FIG. 22 seen in a direction B3 in FIG. 22.
Figure 24:
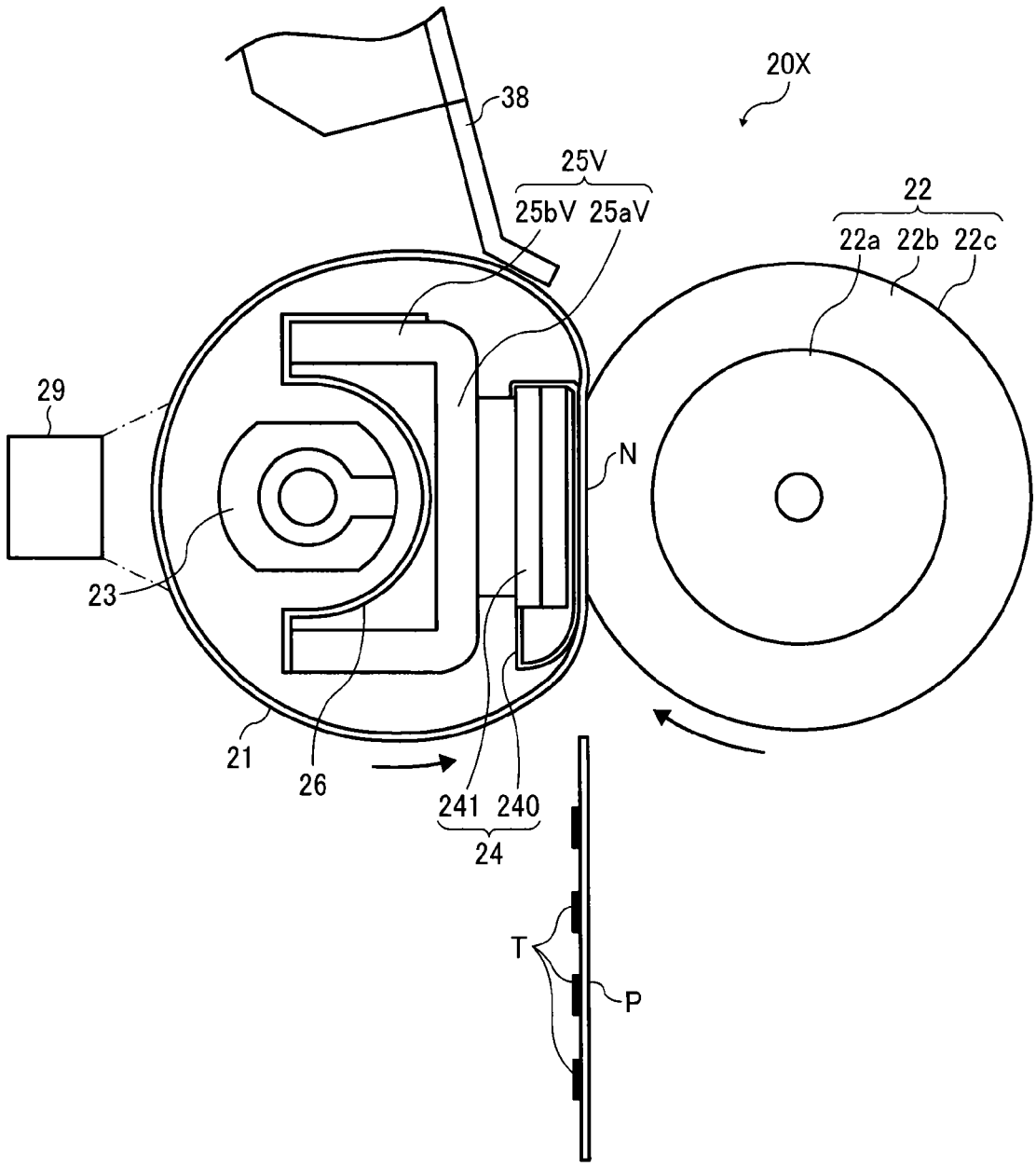
FIG. 24 is a vertical sectional view of the fixing device shown in FIG. 23 taken along line C3-C3 of FIG. 23.
Figure 25:
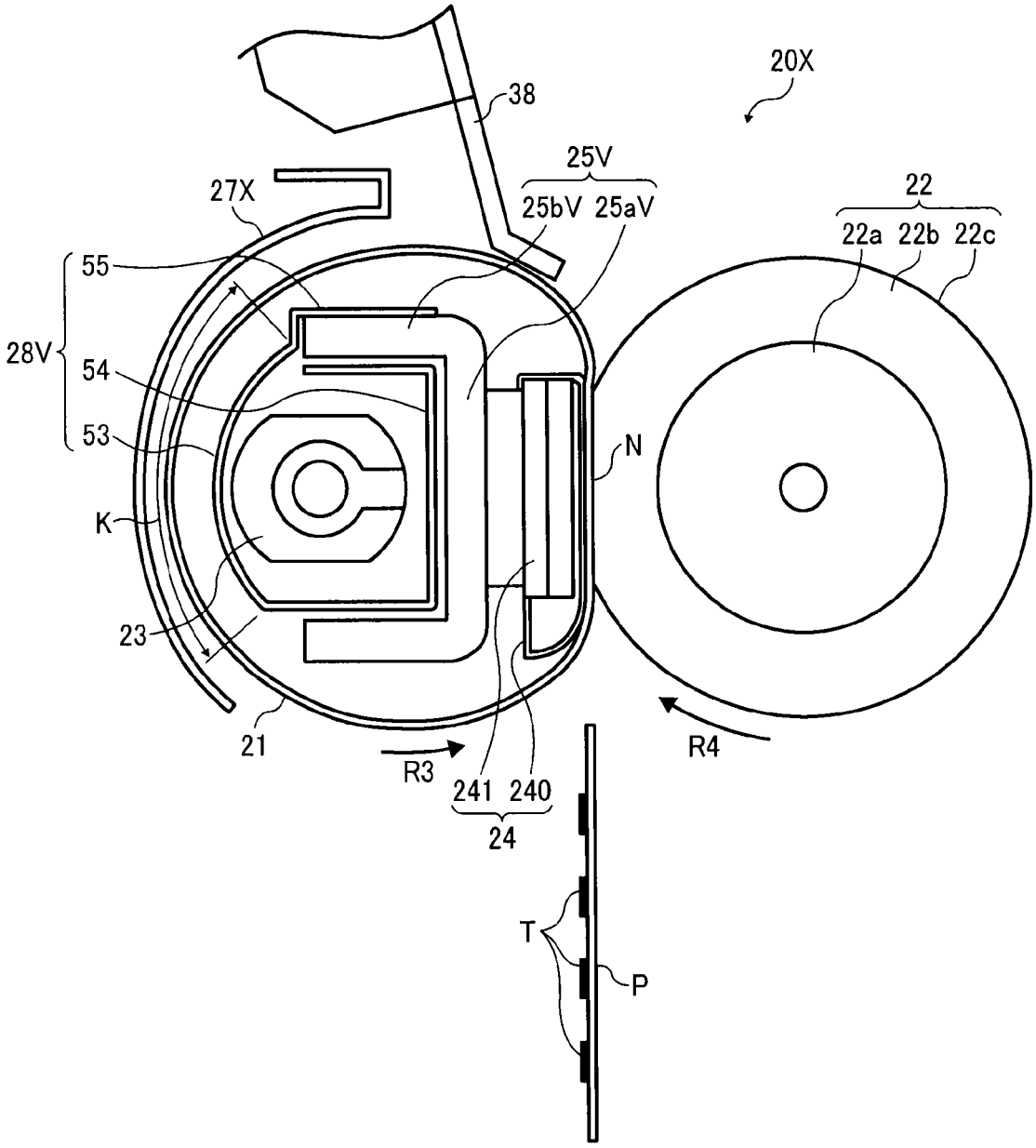
FIG. 25 is a vertical sectional view of the fixing device shown in FIG. 23 taken along line D3-D3 of FIG. 23.

FIG. 22 is a partial perspective view of the fixing device 20X incorporating the stationary heat shields 28V. FIG. 23 is a side view of the fixing device 20X seen in a direction B3 in FIG. 22. FIG. 24 is a vertical sectional view of the fixing device 20X taken along line C3-C3 of FIG. 23 at the center of the fixing belt 21 in the axial direction thereof. FIG. 25 is a vertical sectional view of the fixing device 20X taken along line D3-D3 of FIG. 23 at the lateral end of the fixing belt 21 in the axial direction thereof.

For example, the exterior reflector 27W shown in FIG. 18 spans contiguously from one lateral end to another lateral end of the fixing belt 21 in the axial direction thereof. Contrarily, the fixing device 20X includes an exterior reflector 27X constructed of two separate reflection portions 27Xa shown in FIG. 22 disposed opposite both lateral ends of the fixing belt 21 in the axial direction thereof, respectively. A description of a configuration of other components incorporated in the fixing device 20X is omitted because it is similar to that of the fixing device 20W shown in FIGS. 18 to 21.

The reflection portions 27Xa of the exterior reflector 27X reflect heat radiated from the fixing belt 21 back onto the fixing belt 21 effectively, resulting in effective use of heat at both lateral ends of the fixing belt 21 in the axial direction thereof. A heater generates a decreased amount of heat at both edges of the conveyance span of the fixing belt 21 where the maximum recording medium is conveyed so that the heater does not heat the non-conveyance span of the fixing belt 21 where the maximum recording medium is not conveyed that is outboard from the conveyance span in the axial direction of the fixing belt 21. In this case, the temperature of the fixing belt 21 may decrease at both edges of the conveyance span of the fixing belt 21. To address this circumstance, the reflection portions 27Xa of the exterior reflector 27X disposed opposite at least both lateral ends of the fixing belt 21 in the axial direction thereof, respectively, reflect heat radiated from the fixing belt 21 back onto the fixing belt 21, increasing the temperature of both lateral ends of the fixing belt 21 and attaining an improved fixing property of heating the fixing belt 21 to a desired fixing temperature evenly.

Incidentally, if a heat shield spans contiguously from one lateral end to another lateral end of the fixing belt 21 in the axial direction thereof or a heat shield has shield portions disposed opposite both lateral ends of the fixing belt 21 and connected to each other through a bridge like the heat shield 28 shown in FIG. 7 and the heat shield 28S shown in FIG. 9, the heat shield reduces variation in temperature between one lateral end and another lateral end of the heat shield and facilitates heating of the fixing belt 21 evenly throughout the entire axial span of the fixing belt 21. Additionally, the bridge (e.g., the bridge 49 shown in FIGS. 7 and 9) bridging the two shield portions (e.g., the shield portions 48 shown in FIG. 7 and the great shield portions 48*b* shown in FIG. 9) produces the heat shield (e.g., the heat shields 28 and 28S) into a single unit, facilitating installation of the heat shield inside the fixing devices 20 and 20S.

The fixing devices 20V, 20W, and 20X shown in FIGS. 14 to 25 incorporate the stationary heat shields 28V. Alternatively, the fixing devices 20V, 20W, and 20X may incorporate a movable heat shield such as the heat shields 28 and 28S depicted in FIGS. 7 and 9, respectively.

Figure 26:
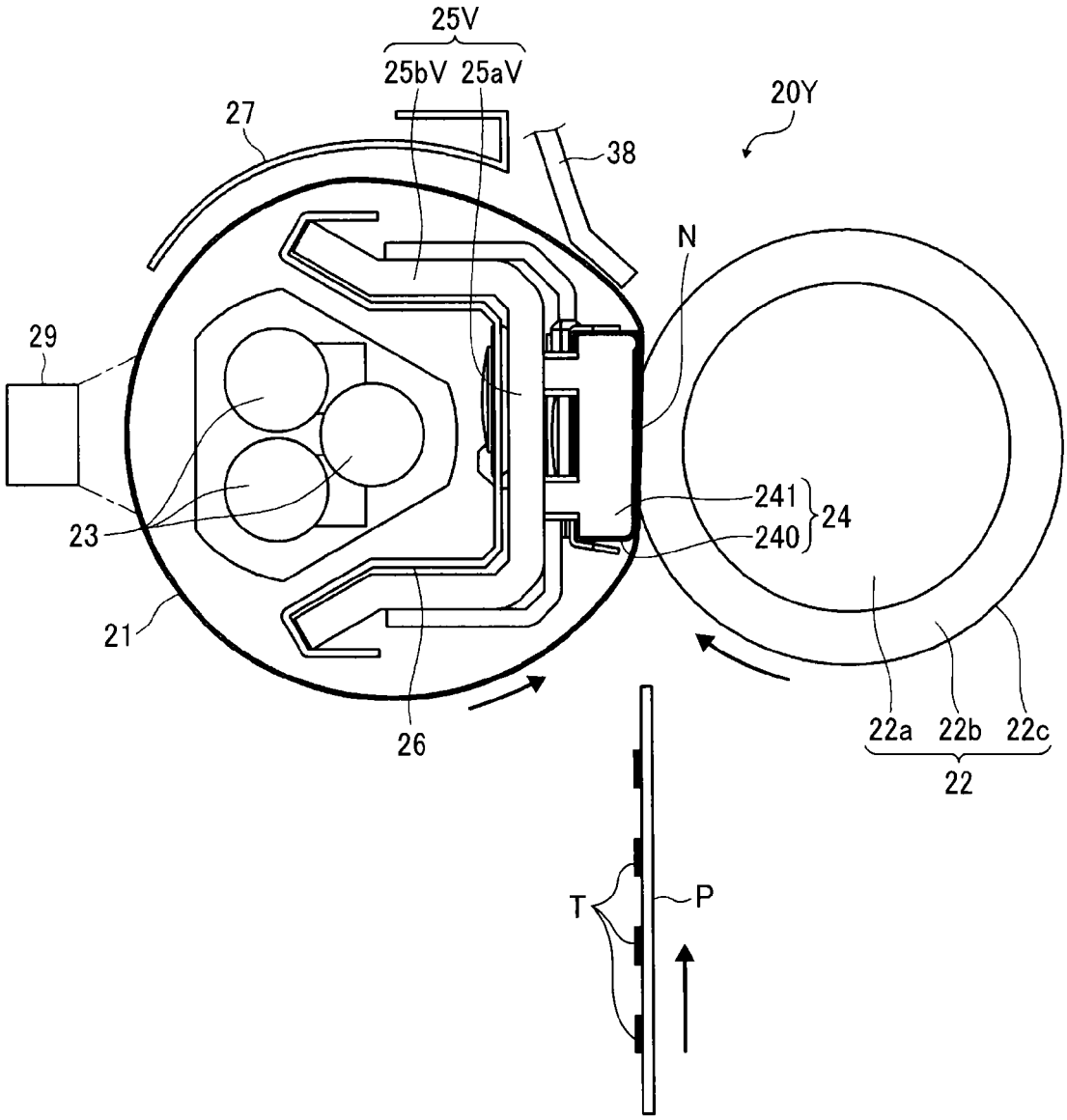
FIG. 26 is a vertical sectional view of a fixing device according to yet another exemplary embodiment.

The present invention is not limited to the details of the exemplary embodiments described above, and various modifications and improvements are possible. For example, the exemplary embodiments described above are applicable to a fixing device 20Y shown in FIG. 26. FIG. 26 is a vertical sectional view of the fixing device 20Y. The fixing device 20Y includes three halogen heaters 23 situated inside the fixing belt 21 at a position different from the position of the halogen heater pair 23 depicted in FIG. 2 and the nip formation assembly 24, the stay 25V, and the interior reflector 26 that have a shape different from that of the nip formation assembly 24, the stay 25, and the interior reflector 26 shown in FIG. 2. Thus, the number and the position of the halogen heaters 23 and the shape of the nip formation assembly 24, the stay 25, and the interior reflector 26 may be modified. The fixing device 20Y further includes the exterior reflector 27 disposed opposite the outer circumferential surface of the fixing belt 21 and spanning a circumferential span of the fixing belt 21 where the fixing belt 21 is in proximity to the stay 25V, that is, where the fixing belt 21 is spaced apart from the stay 25V with a decreased interval therebetween. Accordingly, the exterior reflector 27 reflects heat radiated from the stay 25V onto the fixing belt 21 effectively. FIG. 26 illustrates the fixing device 20Y incorporating no heat shield. Alternatively, the fixing device 20Y may incorporate the movable or stationary heat shield described above (e.g., the movable heat shield 28 depicted in FIG. 7, the movable heat shield 28S depicted in FIG. 9, and the stationary heat shields 28V depicted in FIG. 17).

As described above, the exterior reflectors 27, 27T, 27U, 27W, and 27X are close to the stay 25 that stores a relatively great amount of heat to use heat radiated from the stay 25 effectively. The exterior reflectors 27, 27T, 27U, 27W, and 27X are preferentially located at a position where they heat the fixing belt 21 effectively. Accordingly, the exterior reflectors 27, 27T, 27U, 27W, and 27X are installed efficiently in a limited space inside the compact fixing devices 20, 20S, 20V, 20W, 20X, and 20Y where various components are situated closely, downsizing the fixing devices 20, 20S, 20V, 20W, 20X, and 20Y and enhancing heating efficiency to heat the fixing belt 21 that in turn heats the recording medium P bearing the toner image T.

The fixing devices 20, 20S, 20V, 20W, 20X, and 20Y include the fixing belt 21 serving as a fixing rotator or an endless belt formed into a loop; the nip formation assembly 24 contacting the inner circumferential surface of the fixing belt 21; the pressure roller 22 serving as an opposed rotator contacting the outer circumferential surface of the fixing belt 21 to press against the nip formation assembly 24 via the fixing belt 21; a support (e.g., the stays 25 and 25V) disposed opposite the inner circumferential surface of the fixing belt 21 to support the nip formation assembly 24; the halogen heater pair 23 serving as a heater disposed opposite the inner circumferential surface of the fixing belt 21 to heat the fixing belt 21; and an exterior reflector (e.g., the exterior reflectors 27, 27T, 27U, 27W, and 27X) disposed opposite the outer circumferential surface of the fixing belt 21 to reflect heat radiated from the fixing belt 21 to the fixing belt 21. The exterior reflector spans a circumferential span of the fixing belt 21 where the fixing belt 21 is spaced apart from the support with a decreased interval therebetween.

The exterior reflector spans the circumferential span of the fixing belt 21 where the support is close to the fixing belt 21. That is, the exterior reflector is preferentially located at a position where the fixing belt 21 uses heat from the support efficiently. Accordingly, the exterior reflector reflects heat radiated from the support onto the fixing belt 21 effectively, resulting in effective use of heat.

As shown in FIGS. 7 and 9, the heat shields 28 and 28S have the shield portions 48 and 48S, respectively, disposed at each lateral end of the heat shields 28 and 28S in the longitudinal direction thereof. Alternatively, the shield portions 48 and 48S may be disposed at one lateral end of the heat shields 28 and 28S in the longitudinal direction thereof. In this case, the recording medium P is conveyed over the fixing belt 21 along one lateral edge of the fixing belt 21 in the axial direction thereof and the shield portions 48 and 48S are disposed in proximity to another lateral edge of the fixing belt 21 in the axial direction thereof.

Similarly, as shown in FIG. 22, the heat shield 28V and the exterior reflector 27X are disposed opposite the fixing belt 21 at each lateral end of the fixing belt 21 in the axial direction thereof. Alternatively, the heat shield 28V and the exterior reflector 27X may be disposed opposite the fixing belt 21 at one lateral end of the fixing belt 21 in the axial direction thereof. In this case, the recording medium P is conveyed over the fixing belt 21 along one lateral edge of the fixing belt 21 in the axial direction thereof and the heat shield 28V and the exterior reflector 27X are disposed in proximity to another lateral edge of the fixing belt 21 in the axial direction thereof.

According to the exemplary embodiments described above, the fixing belt 21 serves as a fixing rotator. Alternatively, a fixing film or the like may be used as a fixing rotator. Further, the pressure roller 22 serves as an opposed rotator. Alternatively, a pressure belt or the like may be used as an opposed rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

a nip formation assembly contacting an inner circumferential surface of the fixing rotator;

an opposed rotator to press against the nip formation assembly via the fixing rotator to form a fixing nip between the fixing rotator and the opposed rotator, the fixing nip through which a recording medium is conveyed;

a support disposed opposite the inner circumferential surface of the fixing rotator to support the nip formation assembly;

a heater disposed opposite the inner circumferential surface of the fixing rotator to heat the fixing rotator; and a reflector disposed opposite an outer circumferential surface of the fixing rotator to reflect heat radiated from the fixing rotator onto the fixing rotator, the reflector spanning a circumferential span of the fixing rotator where the fixing rotator is spaced apart from the support with a decreased interval therebetween.

2. The fixing device according to claim 1, further comprising a heat shield interposed between the heater and the fixing rotator to shield the fixing rotator from the heater, wherein the reflector is disposed opposite the heat shield via the fixing rotator.

3. The fixing device according to claim 2, wherein the reflector overlaps the heat shield at least partially in a circumferential direction of the fixing rotator.

4. The fixing device according to claim 2, wherein the heat shield is stationary.

5. The fixing device according to claim 2, wherein the heat shield is movable in a circumferential direction of the fixing rotator between a shield position where the heat shield shields the fixing rotator from the heater and a retracted position where the heat shield does not shield the fixing rotator from the heater.

6. The fixing device according to claim 5, wherein the reflector overlaps the heat shield at least partially in the circumferential direction of the fixing rotator when the heat shield is at the retracted position.

7. The fixing device according to claim 6, wherein the reflector overlaps the heat shield at least partially in the circumferential direction of the fixing rotator when the heat shield is at the shield position.

8. The fixing device according to claim 2, wherein the heat shield includes a slope angled relative to an axial direction of the fixing rotator at each lateral end of the heat shield in the axial direction of the fixing rotator, wherein the reflector includes a slope angled relative to the axial direction of the fixing rotator at each lateral end of the reflector in the axial direction of the fixing rotator, and wherein the slope of the reflector corresponds to the slope of the heat shield.

9. The fixing device according to claim 1, further comprising a temperature sensor disposed opposite the outer circumferential surface of the fixing rotator to detect a temperature of the fixing rotator, wherein the temperature sensor does not overlap the reflector in a circumferential direction of the fixing rotator.

10. The fixing device according to claim 1, wherein the circumferential span of the fixing rotator corresponds to a circumferential length of the reflector in a circumferential direction of the fixing rotator that is even throughout an axial heating span of the heater in an axial direction of the fixing rotator.

11. The fixing device according to claim 1, wherein the reflector includes a reflection face disposed opposite the outer circumferential surface of the fixing rotator, and wherein the reflection face of the reflector is spaced apart from the outer circumferential surface of the fixing rotator with a gap that is even throughout the entire reflection face of the reflector.

12. The fixing device according to claim 1, wherein a length of the reflector in an axial direction of the fixing rotator is greater than an axial heating span of the heater in the axial direction of the fixing rotator.

13. The fixing device according to claim 1, wherein a length of the reflector in an axial direction of the fixing rotator is greater than a length of the fixing nip in the axial direction of the fixing rotator.

14. The fixing device according to claim 1, further comprising a heat shield disposed opposite each lateral end of the fixing rotator in an axial direction thereof, wherein each heat shield includes:

a first shield portion interposed between the heater and the fixing rotator;

a second shield portion interposed between the heater and the support; and a mounted portion mounted on the support.

15. The fixing device according to claim 14, wherein the reflector partially overlaps the first shield portion of each heat shield in the axial direction and a circumferential direction of the fixing rotator.

16. The fixing device according to claim 14, wherein the reflector overlaps the first shield portion of each heat shield substantially entirely in a circumferential direction of the fixing rotator.

17. The fixing device according to claim 16, further comprising a temperature sensor disposed opposite the outer circumferential surface of the fixing rotator to detect a temperature of the fixing rotator, wherein the reflector includes a slot disposed opposite the temperature sensor, the slot through which the temperature sensor detects the temperature of the fixing rotator.

18. The fixing device according to claim 14, wherein the reflector includes a reflection portion disposed opposite each lateral end of the fixing rotator in the axial direction of the fixing rotator.

19. The fixing device according to claim 18, wherein the reflection portion of the reflector and the heat shield are disposed opposite a non-conveyance span of the fixing rotator where the recording medium is not conveyed over the fixing rotator.

20. An image forming apparatus comprising:

an image forming device to form a toner image; and a fixing device to fix the toner image formed by the image forming device on a recording medium, the fixing device including:

a fixing rotator rotatable in a predetermined direction of rotation;

a nip formation assembly contacting an inner circumferential surface of the fixing rotator;

an opposed rotator to press against the nip formation assembly via the fixing rotator to form a fixing nip between the fixing rotator and the opposed rotator, the fixing nip through which the recording medium is conveyed;

a support disposed opposite the inner circumferential surface of the fixing rotator to support the nip formation assembly;

a heater disposed opposite the inner circumferential surface of the fixing rotator to heat the fixing rotator; and a reflector disposed opposite an outer circumferential surface of the fixing rotator to reflect heat radiated from the fixing rotator onto the fixing rotator, the reflector spanning a circumferential span of the fixing rotator where the fixing rotator is spaced apart from the support with a decreased interval therebetween.

* * * * *